US011845168B2

(12) United States Patent
Tsuji et al.

(10) Patent No.: US 11,845,168 B2
(45) Date of Patent: Dec. 19, 2023

(54) RECIPROCATING TOOL

(71) Applicant: MAKITA CORPORATION, Anjo (JP)

(72) Inventors: Hideki Tsuji, Anjo (JP); Hajime Takeuchi, Anjo (JP); Kei Watanabe, Anjo (JP); Kazuo Muramatsu, Anjo (JP); Masahiro Maegawa, Anjo (JP)

(73) Assignee: MAKITA CORPORATION, Anjo (JP)

( * ) Notice: Subject to any disclaimer, the term of this patent is extended or adjusted under 35 U.S.C. 154(b) by 0 days.

(21) Appl. No.: 17/074,673

(22) Filed: Oct. 20, 2020

(65) Prior Publication Data

US 2021/0129307 A1 May 6, 2021

(30) Foreign Application Priority Data

Nov. 1, 2019 (JP) ..... 2019-199828
Nov. 1, 2019 (JP) ..... 2019-199830

(51) Int. Cl.
*B25D 11/12* (2006.01)
*B25D 17/04* (2006.01)
(Continued)

(52) U.S. Cl.
CPC ..... *B25D 11/12* (2013.01); *B25D 17/04* (2013.01); *B25D 17/24* (2013.01); *B25D 11/04* (2013.01);
(Continued)

(58) Field of Classification Search
CPC ..... B25D 11/04; B25D 11/12; B25D 17/24; B25D 2217/0003; B25D 2250/095
See application file for complete search history.

(56) References Cited

U.S. PATENT DOCUMENTS 5,310,157 A * 5/1994 Platus ..... F16F 15/073 248/619
6,776,245 B2 * 8/2004 Kristen ..... B25D 17/20 173/171
(Continued)

FOREIGN PATENT DOCUMENTS

CN 1613614 A 5/2005
CN 101247926 A 8/2008
(Continued)

OTHER PUBLICATIONS

Apr. 14, 2023 Office Action issued in Chinese Patent Application No. 202011195114.8.
(Continued)

*Primary Examiner* — Thomas M Wittenschlaeger
*Assistant Examiner* — David G Shutty
(74) *Attorney, Agent, or Firm* — Oliff PLC

(57) ABSTRACT

A reciprocating tool includes a motor, a driving mechanism, a body housing, a movable part, and a vibration control mechanism. The driving mechanism includes a reciprocating member configured to reciprocate in a first direction. The movable part is connected to the body housing via a first elastic member and a second elastic member to be relatively movable in the first direction. The vibration control mechanism includes at least one weight configured to move in a direction opposite to the reciprocating member. The center of gravity of the at least one weight is offset from the driving axis in a second direction. In the second direction, the first elastic member is closer to the center of gravity than the second elastic member. A load of the first elastic member when the movable part is placed in a closer position is smaller than a load of the second elastic member.

17 Claims, 12 Drawing Sheets

(51) Int. Cl.
*B25D 17/24* (2006.01)
*B25D 11/04* (2006.01)

(52) U.S. Cl.
CPC ..... *B25D 2217/0003* (2013.01); *B25D 2250/095* (2013.01)

(56) References Cited

U.S. PATENT DOCUMENTS

| | | | | |
|---|---|---|---|---|
| 6,962,211 | B2 * | 11/2005 | Daubner | B25D 17/24 173/162.1 |
| 7,322,428 | B2 * | 1/2008 | Bacila | B25D 17/043 16/431 |
| 7,588,097 | B2 * | 9/2009 | Kamegai | B25D 11/062 173/217 |
| 7,604,071 | B2 * | 10/2009 | Ikuta | B25D 17/24 173/210 |
| 7,712,547 | B2 * | 5/2010 | Ikuta | B25D 17/24 173/162.1 |
| 7,806,201 | B2 * | 10/2010 | Aoki | B23D 51/16 173/210 |
| 8,181,715 | B2 * | 5/2012 | Bito | B25D 17/245 267/136 |
| 8,561,716 | B2 * | 10/2013 | Aoki | B25D 17/24 173/162.1 |
| 8,844,647 | B2 * | 9/2014 | Kamegai | B25D 17/245 173/210 |
| 8,985,236 | B2 * | 3/2015 | Wierer | B25D 17/24 173/162.1 |
| 9,193,057 | B2 * | 11/2015 | Mossnang | F16F 7/116 |
| 9,505,118 | B2 * | 11/2016 | Furusawa | B25D 17/24 |
| 9,950,415 | B2 * | 4/2018 | Takeuchi | B25D 17/20 |
| 9,950,418 | B2 * | 4/2018 | Kakiuchi | B25F 5/02 |
| 9,999,967 | B2 * | 6/2018 | Furusawa | B25D 17/043 |
| 10,022,852 | B2 * | 7/2018 | Ikuta | B25D 11/04 |
| 10,513,022 | B2 * | 12/2019 | Machida | B25D 17/04 |
| 10,518,400 | B2 * | 12/2019 | Furusawa | B25D 17/24 |
| 2006/0011365 | A1 | 1/2006 | Stirm et al. | |
| 2007/0149951 | A1 * | 6/2007 | Wu | A61M 25/09 604/526 |
| 2009/0004908 | A1 | 1/2009 | Ceroll et al. | |
| 2009/0314507 | A1 | 12/2009 | Iwakami | |
| 2010/0018734 | A1 | 1/2010 | Frauhammer et al. | |
| 2010/0132969 | A1 | 6/2010 | Bito et al. | |
| 2010/0236801 | A1 * | 9/2010 | Furusawa | B25D 11/10 173/162.2 |
| 2012/0031638 | A1 | 2/2012 | Kamegai et al. | |
| 2012/0055689 | A1 * | 3/2012 | Wierer | B25D 17/043 173/162.2 |
| 2012/0267136 | A1 | 10/2012 | Mossnang | |
| 2012/0279740 | A1 | 11/2012 | Furusawa et al. | |
| 2015/0266176 | A1 | 9/2015 | Takeuchi et al. | |
| 2015/0328759 | A1 | 11/2015 | Ikuta et al. | |
| 2017/0320206 | A1 * | 11/2017 | Machida | B25D 17/24 |
| 2018/0001463 | A1 * | 1/2018 | Furusawa | B25D 17/24 |
| 2021/0129307 | A1 * | 5/2021 | Tsuji | B25D 17/04 |

FOREIGN PATENT DOCUMENTS

| | | | | |
|---|---|---|---|---|
| CN | 102343577 | A | 2/2012 | |
| CN | 102666029 | A | 9/2012 | |
| CN | 102744715 | A | 10/2012 | |
| CN | 204195709 | U | 3/2015 | |
| DE | 100 36 078 | B4 | 4/2007 | |
| JP | 07253338 | A * | 10/1995 | F16F 15/06 |
| JP | H-7253338 | A * | 10/1995 | G01D 11/30 |
| JP | 2000-52279 | A | 2/2000 | |
| JP | 2007-175836 | A | 7/2007 | |
| JP | 2010-000567 | A | 1/2010 | |
| JP | 2010-131694 | A | 6/2010 | |
| JP | 2011-131364 | A | 7/2011 | |
| JP | 2015-182167 | A | 10/2015 | |
| JP | 2015-217470 | A | 12/2015 | |

OTHER PUBLICATIONS

May 16, 2023 Office Action issued in Japanese Patent Application No. JP2019-199830.

Jun. 6, 2023 Office Action issued in Japanese Patent Application No. 2019-199828.

* cited by examiner

RECIPROCATING TOOL

CROSS-REFERENCE TO RELATED APPLICATIONS

The present application claims priority to Japanese patent application No. 2019-199828 filed on Nov. 1, 2019, and Japanese patent application No. 2019-199830 filed on Nov. 1, 2019. The contents of the foregoing applications are entirely incorporated herein by reference.

TECHNICAL FIELD

The present disclosure relates to a reciprocating tool configured to linearly drive a tool accessory.

BACKGROUND

A reciprocating tool is known that is configured to linearly drive a tool accessory using a reciprocating member that linearly reciprocates along a driving axis. In the reciprocating tool, relatively large vibration is generated in a direction of the driving axis. Thus, a reciprocating tool is known that includes a vibration control mechanism for reducing the vibration. For example, Japanese Unexamined Patent Application Publication No. 2015-182167 discloses an electric hammer that includes a dynamic vibration reducer.

SUMMARY

One aspect of the present disclosure provides a reciprocating tool that includes a motor, a driving mechanism, a body housing, a movable part, and a vibration control mechanism. The motor has an output shaft. The driving mechanism includes a reciprocating member configured to reciprocate along a driving axis in a first direction (namely, in an extension direction of a driving axis) using power from the motor. The driving mechanism is configured to linearly drive a tool accessory in response to reciprocation of the reciprocating member. The body housing houses the motor and the driving mechanism. The movable part is connected to the body housing via a first elastic member and a second elastic member such that the movable part is movable relative to the body housing in the first direction between an initial position and a closer position. The movable part is located closer to the body housing in the closer position than in the initial position. The movable part includes a grip configured to be gripped by a user. The vibration control mechanism is disposed in the body housing. The vibration control mechanism includes at least one weight. The at least one weight is configured to move in a direction opposite to the reciprocating member in response to the reciprocation of the reciprocating member.

The center of gravity of the at least one weight is offset from the driving axis in a second direction. The second direction is orthogonal to the driving axis. In the second direction, the first elastic member is disposed at a position closer to the center of gravity than the second elastic member. In other words, a distance between the first elastic member and the center of gravity in the second direction is shorter than a distance between the second elastic member and the center of gravity in the second direction. Further, a load of the first elastic member when the movable part is placed in the closer position is smaller than a load of the second elastic member when the movable part is placed in the closer position. In other words, a biasing force, which biases the body housing and the movable part to be separated (spaced apart) from each other, of the first elastic member when the movable part is placed in the closer position is smaller than a biasing force of the second elastic member when the movable part is placed in the closer position.

DETAILED DESCRIPTION OF EMBODIMENTS

Hereinafter, an electric hammer 101 according to an embodiment will be described with reference to the drawings. The electric hammer (hereinafter, simply referred to as the hammer) 101 is a power tool configured to perform an operation (hereinafter, referred to as a hammering operation) to linearly drive a tool accessory 91 along a predetermined driving axis A1. The electric hammer 101 can be used for a chipping operation or a scraping operation.

Figure 1:
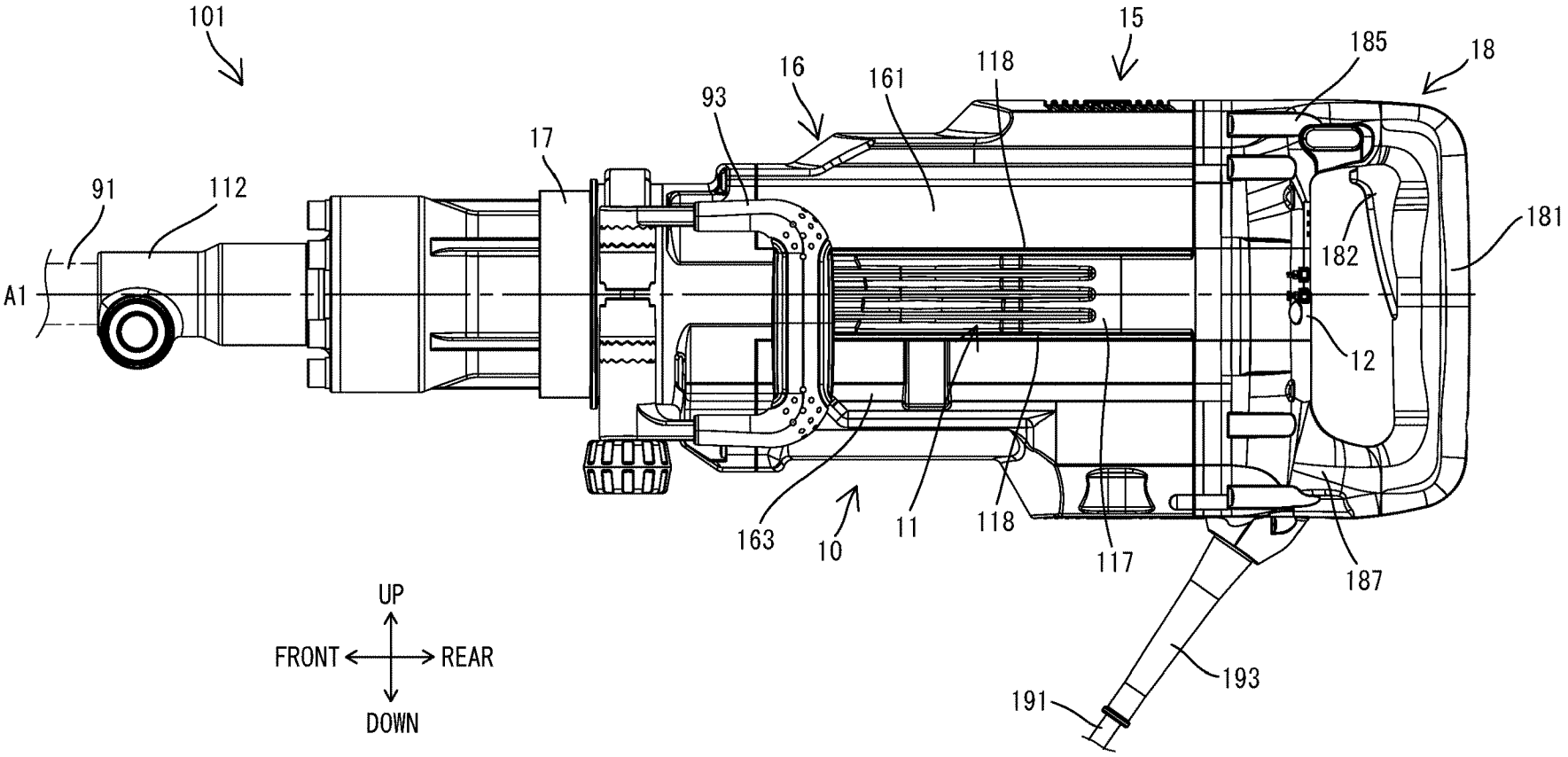
FIG. 1 is a left side view of an electric hammer.
Figure 2:
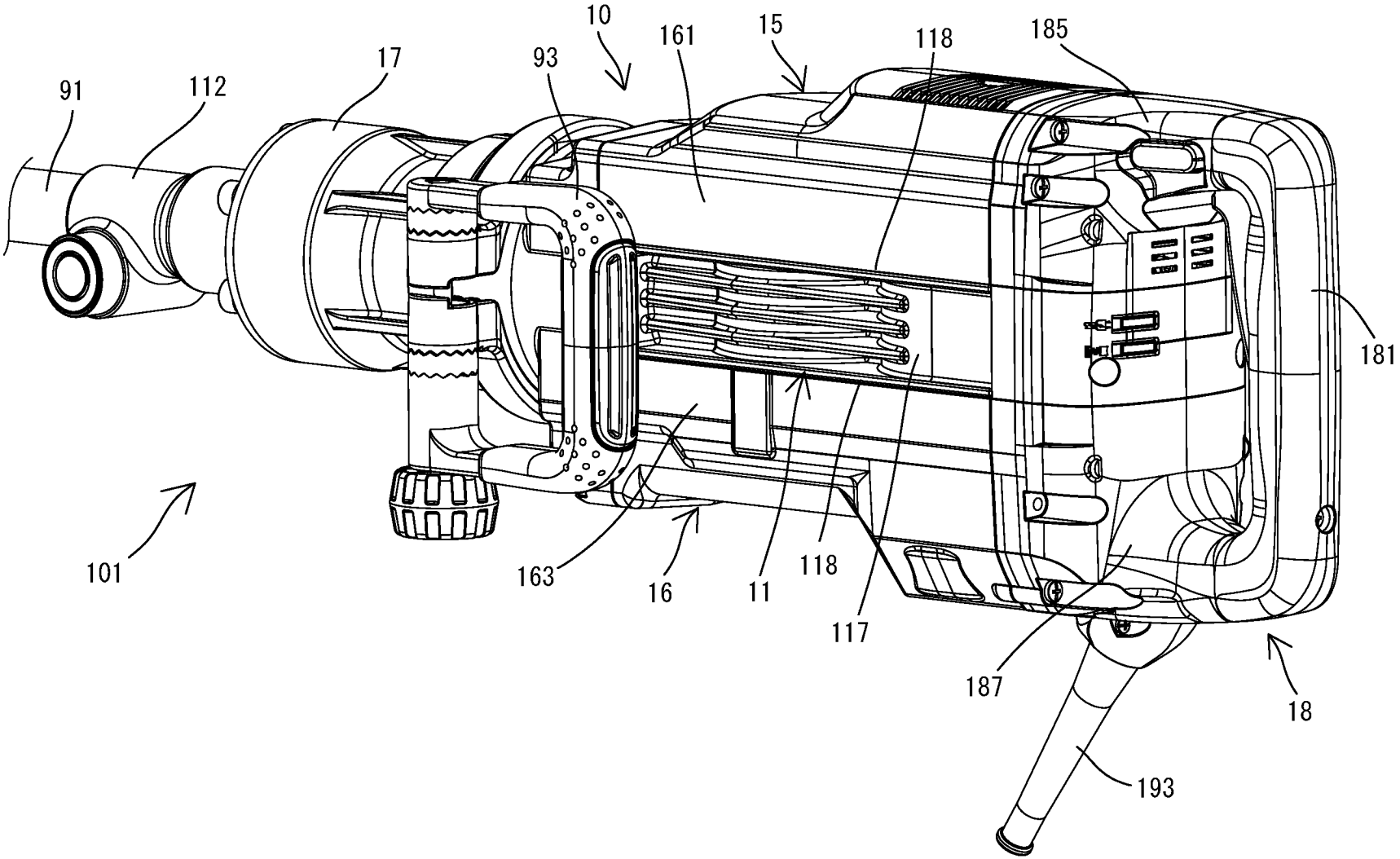
FIG. 2 is a perspective view of the electric hammer.
Figure 3:
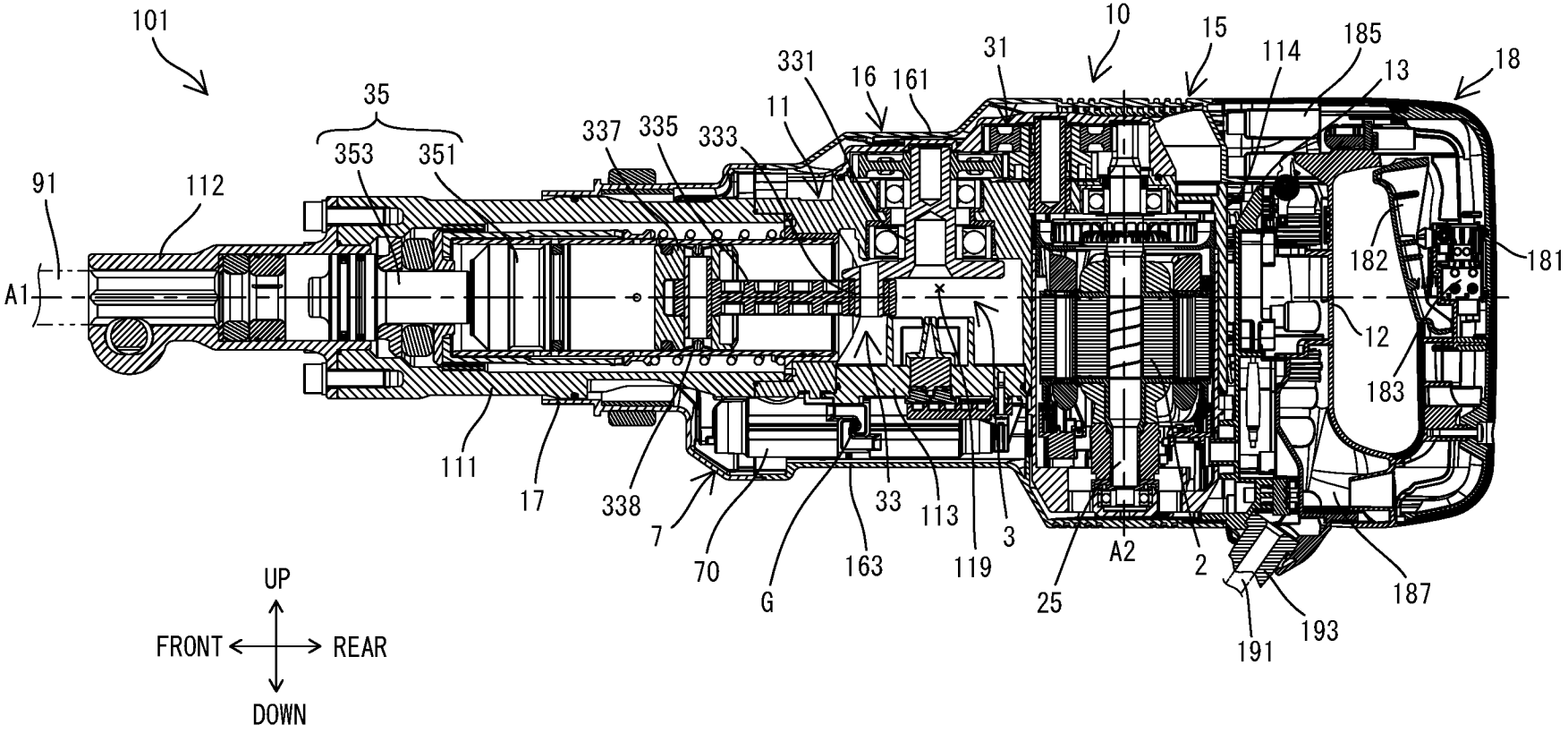
FIG. 3 is a cross-sectional view of the electric hammer.

Firstly, a general configuration of the hammer 101 is described. As shown in FIG. 1 to FIG. 3, an outer shell of the hammer 101 is mainly formed by a housing 10. The housing 10 extends along the driving axis A1.

A cylindrical tool holder 112 is fixedly connected to one end portion of the housing 10 in an extension direction of the driving axis A1 (hereinafter, simply referred to as a driving-axis direction). The tool holder 112 is arranged coaxially around the driving axis A1. The tool holder 112 is configured to removably hold the tool accessary 91. The tool accessory 91 is inserted into an insertion hole formed in a front end portion of the tool holder 112 such that an axis of the tool accessory 91 coincides with the driving axis A1. The tool accessory 91 is held by the tool holder 112 such that movement of the tool accessory 91 in the axial direction relative to the tool holder 112 is allowed and the rotation of the tool accessory 91 around the axis relative to the tool holder 112 is restricted (blocked).

An elongate grip 181, which is configured to be gripped by a user, is provided in the other end portion of the housing 10 in the driving-axis direction. The grip 181 extends in a direction that is substantially orthogonal to the driving axis A1. A portion of the grip 181 is located on the driving axis A1. The grip 181 has a trigger 182, which is configured to be depressed by a user. The trigger 182 is disposed in (on) one end portion in a longitudinal direction of the grip 181. When the trigger 182 is depressed by a user, the tool accessory 91 is linearly driven along the driving axis A1.

Hereinafter, a detailed configuration of the hammer 101 is described. In the following description, for convenience of explanation, the driving-axis direction (or a longitudinal direction of the housing 10) is defined as a front-rear direction of the hammer 101. In the front-rear direction, a side of the hammer 101 on which the tool holder 112 is disposed is defined as a front side of the hammer 101, and an opposite side thereof (a side on which the grip 181 is disposed) is defined as a rear side of the hammer 101. The longitudinal direction of the grip 181 is defined as an up-down direction of the hammer 101. In the up-down direction, a side of the hammer 101 on which the trigger 182 is disposed is defined as an upper side, and an opposite side thereof is defined as a lower side. A direction that is orthogonal to both of the front-rear direction and the up-down direction is defined as a left-right direction.

Firstly, a configuration of the housing 10 is described. The housing 10 of the present embodiment is formed as a so-called vibration-isolating housing. The housing 10 includes a body housing 11, and a movable housing 15 that is elastically connected to the body housing 11 so as to be movable relative to the body housing 11.

As shown in FIG. 3, the body housing 11 mainly houses a motor 2 and a driving mechanism 3. A front half of the body housing 11 has a circular cylindrical shape. The front half having the circular cylindrical shape is hereinafter referred to as a barrel 111. The tool holder 112 is fixed to a front end portion of the barrel 111 using screws. A rear half of the body housing 11 (i.e. a portion of the body housing 11 other than the barrel 111) has a generally rectangular box-like shape. The rear half having the rectangular box-like shape is hereinafter referred to as a body 113.

Figure 4:
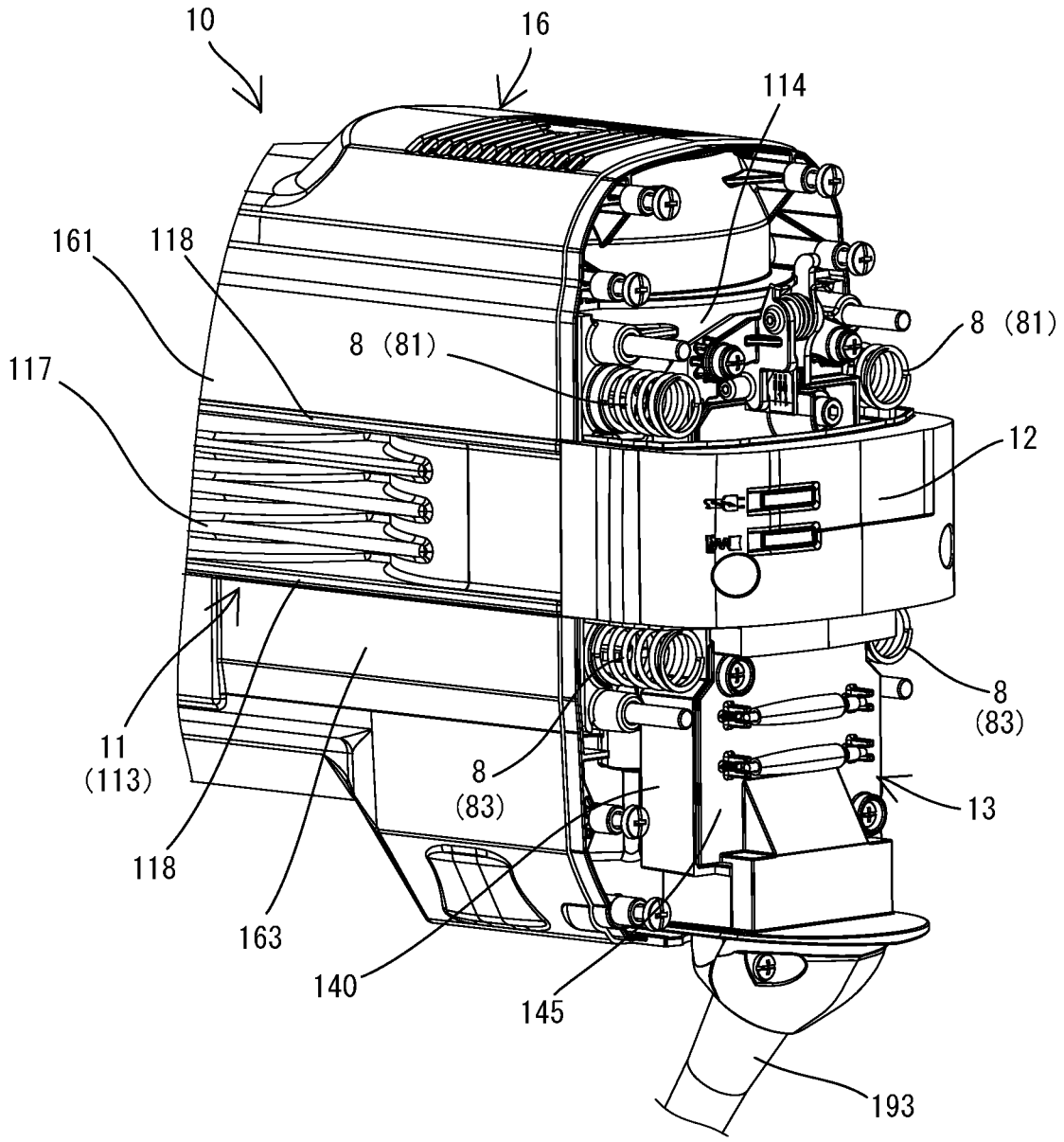
FIG. 4 is a perspective view of a rear end portion of the electric hammer in a state in which a handle is removed (wherein wires are not shown).

As shown in FIG. 3 and FIG. 4, a controller case 13 and a rear cover 12 are fixed to a rear wall 114 of the body housing 11 (body 113). The controller case 13 is an elongate rectangular box-like member. The controller case 13 is arranged to extend in the up-down direction and is fixed to the rear wall 114 of the body 113 using screws. The rear cover 12 has a U-shaped cross-section. The rear cover 12 is fixed to the controller case 13 using screws such that both end portions of the rear cover 12 contact a left end portion and a right end portion of a center region (an exposure region 117, which will be described below) in the up-down direction of the rear wall 114. The rear cover 12 covers a portion of the controller case 13 (specifically, a first housing space 131 to be described below). With such a configuration, the controller case 13 and the rear cover 12 are integrated with the body housing 11.

As shown in FIG. 1 to FIG. 4, the movable housing 15 is a housing that covers a portion of the body housing 11 and that includes the grip 181. More specifically, the movable housing 15 includes an outer housing 16, a barrel cover 17 and a handle 18.

The outer housing 16 includes an upper part 161 and a lower part 163. The upper part 161 covers an upper surface and upper portions of left and right side surfaces of the body 113 of the body housing 11. The lower part 163 covers a lower surface and lower portions of the left and right side surfaces of the body 113 of the body housing 11. Each of the upper part 161 and the lower part 163 has a U-shaped cross-section. The upper part 161 and the lower part 163 have substantially the same length as a length of the body 113 in the front-rear direction. Left and right lower ends of the upper part 161 and left and right upper ends of the lower part 163 are spaced apart from each other, respectively. Thus, a gap is formed between the upper part 161 and the lower part 163 in the up-down direction.

With such an arrangement, a central region in the up-down direction of the left side surface of the body 113 is exposed to an outside through the gap between the upper part 161 and the lower part 163. Although not shown, a central region in the up-down direction of the right side surface of the body 113 is similarly exposed to the outside through the gap between the upper part 161 and the lower part 163. Hereinafter, these regions are referred to as the exposure regions 117. The exposure regions 117 each extend in the front-rear direction from the front end to the rear end of the body 113.

The barrel cover 17 is a portion of the movable housing 15 that has a cylindrical shape and covers the barrel 111 of the body housing 11. The barrel cover 17 is fixed to the front end portions of the upper part 161 and the lower part 163 using screws. An auxiliary handle 93 can be detachably attached to the barrel cover 17.

The handle 18 is formed as a hollow body having a C-shape in a side view as a whole. The handle 18 includes the grip 181, an upper connection part 185, and a lower connection part 187. The grip 181 has an elongate cylindrical shape and is arranged to extend in the up-down direction. The upper connection part 185 and the lower connection part 187 are connected to the upper end portion and the lower end portion of the grip 181, respectively, and extend frontward. The upper connection part 185 and the lower connection part 187 are fixed to the rear end portions of the upper part 161 and the lower part 163, respectively, using screws, and cover an upper rear end portion and a lower rear end portion of the body housing 11, respectively. The rear cover 12 is disposed between the upper connection part 185 and the lower connection part 187 in the up-down direction. As described above, the rear cover 12 is fixed to the body housing 11 via the controller case 13.

In this way, the outer housing 16, the barrel cover 17, and the handle 18 are integrated to form the movable housing 15.

Figure 5:
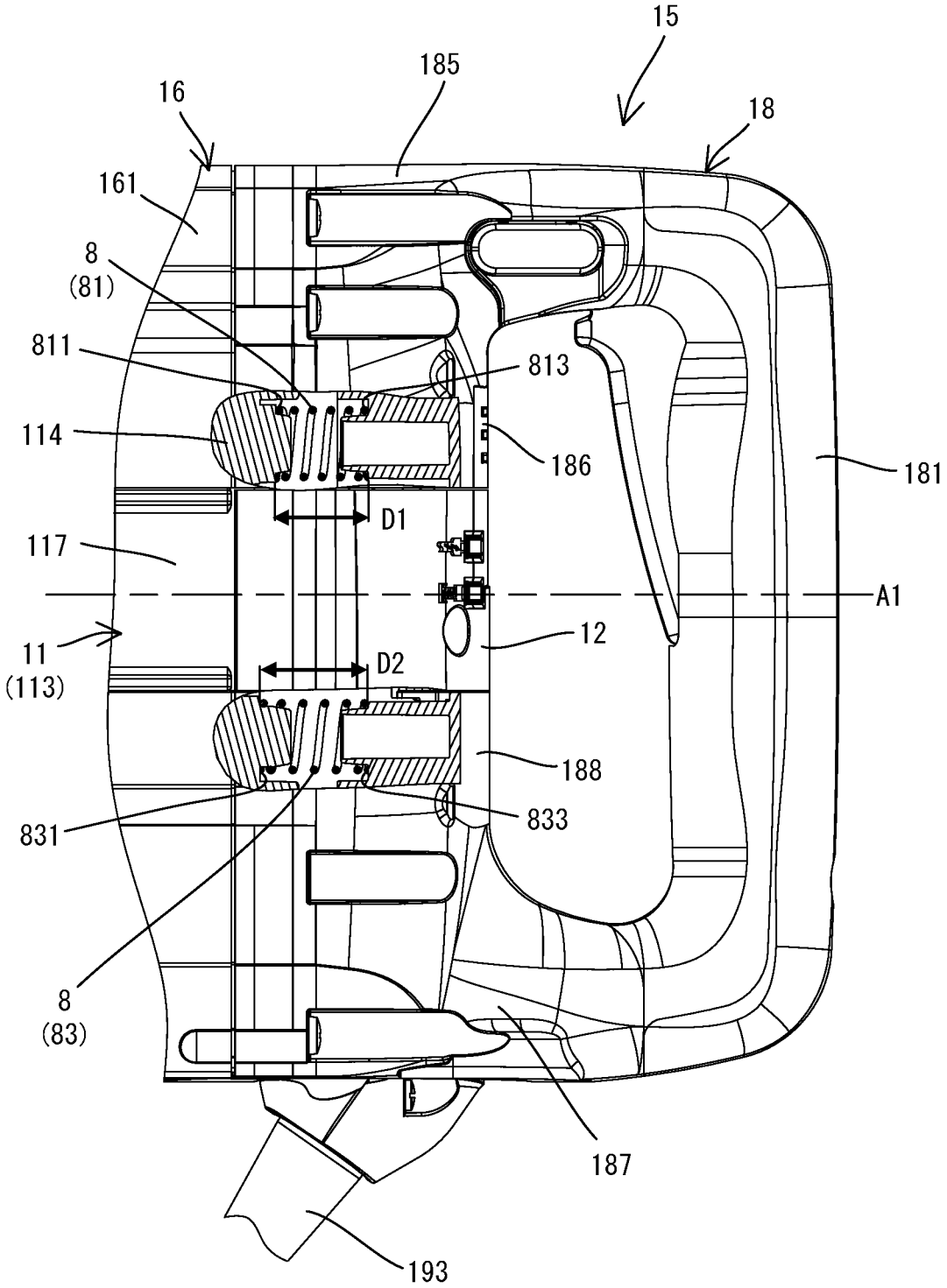
FIG. 5 is a partial cross-sectional view of the rear end portion of the electric hammer for explaining an elastic connection structure between a body housing and a movable housing.

Further, as shown in FIG. 4 and FIG. 5, elastic members 8 are disposed between the body housing 11 and the movable housing 15. More specifically, four elastic members 8 are interposed between the rear wall 114 of the body housing 11 and the handle 18 of the movable housing 15 so as to bias the body housing 11 and the movable housing 15 to be separated (spaced apart) from each other in the front-rear direction. The body housing 11 and the movable housing 15 are movable relative to each other in the front-rear direction while the body housing 11 and the movable housing 15 are biased frontward and rearward, respectively.

In the present embodiment, two of the four elastic members 8 are disposed on an upper side of the driving axis A1, and the other two elastic members 8 are disposed on a lower side of the driving axis A1. Hereinafter, when the elastic members 8 are distinguished, the elastic members 8 located on the upper side of the driving axis A1 are referred to as upper elastic members 81, and the elastic members 8 located on the lower side of the driving axis A1 are referred to as lower elastic members 83. In the present embodiment, each of the elastic members 8 is a compression coil spring.

The upper elastic members 81 extend in the front-rear direction. A front end portion and a rear end portion of each of the upper elastic members 81 are supported by a spring receiving part 811 and a spring receiving part 813, respectively. The spring receiving part 811 is provided on a rear surface of the rear wall 114. The spring receiving part 813 is provided on a front surface of the rear wall 186 of the upper connection part 185. The upper elastic members 81 are symmetrically arranged with respect to a plane P (see FIG. 10). The plane P is an imaginary plane that contains the driving axis A1 and extends in the up-down direction (an imaginary plane that contains the driving axis A1 and a rotation axis A2 of the motor 2). The lower elastic members 83 also extend in the front-rear direction. A front end portion and a rear end portion of each of the lower elastic members 83 are supported by a spring receiving part 831 and a spring receiving part 833, respectively. The spring receiving part 831 is provided on a rear surface of the rear wall 114. The spring receiving part 833 is provided on a front surface of the rear wall 186 of the upper connection part 185. The lower elastic members 83 are also symmetrically arranged with respect to the plane P. The two lower elastic members 83 are disposed directly below the two upper elastic members 81, respectively.

Figure 6:
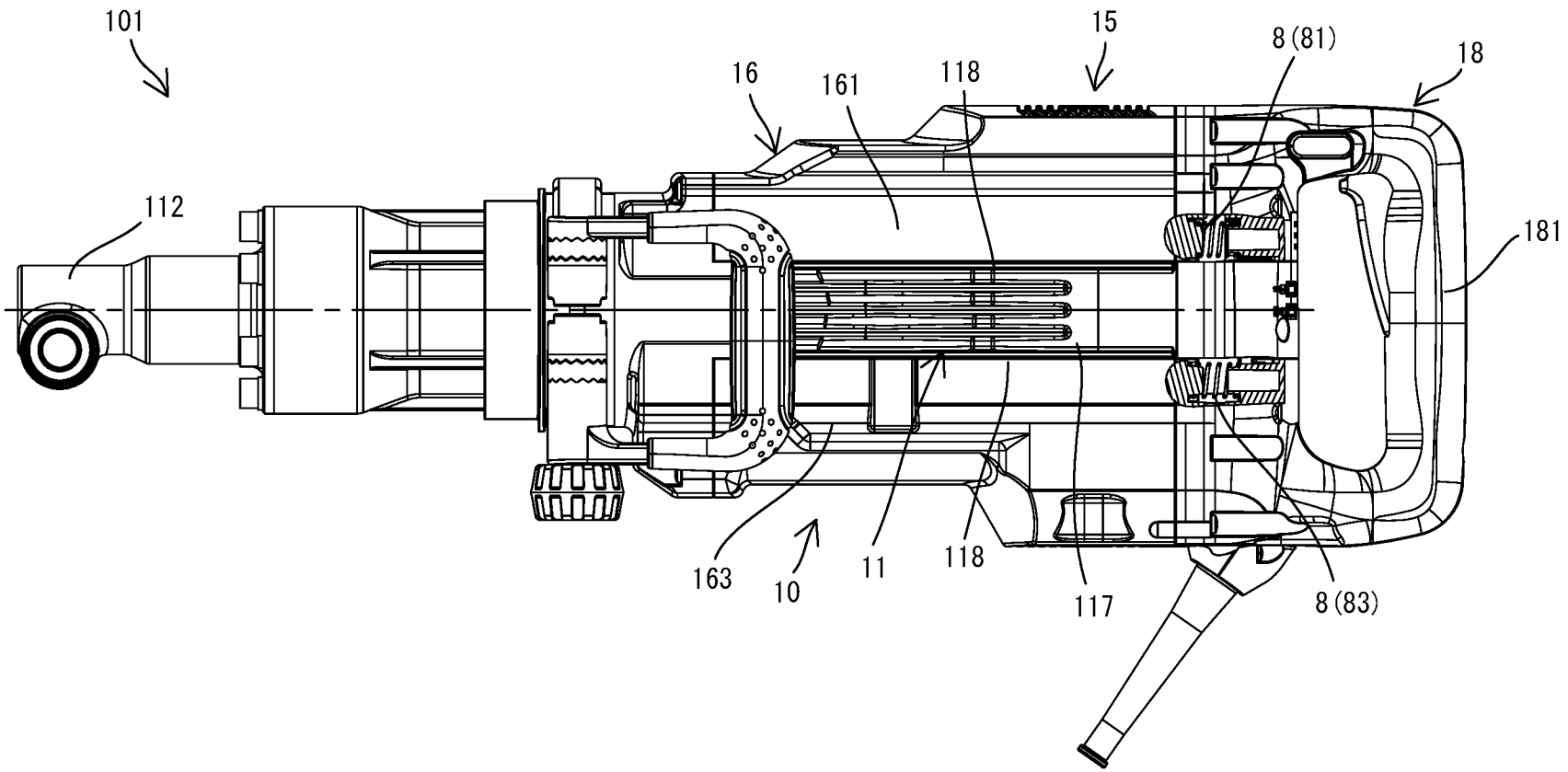
FIG. 6 is an explanatory view of the electric hammer in a state in which the movable housing is located in an initial position.

With such an elastic connection structure, in an initial state in which a force toward the body housing 11 is not applied to the movable housing 15, the movable housing 15 is placed in an initial position shown in FIG. 5 and FIG. 6. The initial position of the movable housing 15 is a rearmost position within a movable range of the movable housing 15 relative to the body housing 11. Although not shown, stoppers are provided on the body housing 11 and the movable housing 15, respectively, so that the stoppers define the initial position of the movable housing 15 (i.e. the stoppers restrict rearward movement of the movable housing 15 beyond the initial position) by abutting against each other. In a state in which the movable housing 15 is located in the initial position relative to the body housing 11, the rear surface of the rear wall of the rear cover 12, the rear surface of the rear wall 186 of the upper connection part 185, and the rear surface of the rear wall 188 of the lower connection part 186 are generally flush with each other.

On the other hand, in a case in which a force toward the body housing 11 is applied to the movable housing 15, the movable housing 15 is moved to be closer to the body housing 11 (namely, forward), against the biasing force of the elastic members 8. In the present embodiment, the movable housing 15 is movable to a position shown in FIG. 7 (hereinafter, referred to as a closer position). The closer position of the movable housing 15 is a frontmost position within the movable range of the movable housing 15 relative to the body housing 11. Although not shown, stoppers are provided on the body housing 11 and the movable housing 15, respectively, so that the stoppers define the closer position of the movable housing 15 (i.e. the stoppers restrict forward movement of the movable housing 15 beyond the closer position) by abutting against each other.

Sliding guides 118 extend along an upper end and a lower end of the left and right exposure regions 117 of the body housing 11 (i.e. in the front-rear direction), respectively. These sliding guides 118 are each formed as a projection protruding leftward from the left side surface or protruding rightward from the right side surface of the body housing 11. The movable housing 15 is moved and guided relative to the body housing 11 in the front-rear direction while the lower ends of the upper part 161 and the upper ends of the lower part 163 of the outer housing 16 slide along the sliding guides 118 at the upper ends and the lower ends of the exposure regions 117.

In the present embodiment, a load of the upper elastic member 81 when the movable housing 15 is located at the closer position is different from a load of the lower elastic member 83 when the movable housing 15 is located at the closer position. The load can also be called as a biasing force (elastic force) that biases the body housing 11 and the movable housing 15 to be separated (spaced apart) from each other. More specifically, compression coil springs having the same configuration are employed for all of the four elastic members 8. In other words, all of the four elastic members 8 are the compression coil springs having the same shape and formed of the same material, and therefore all the elastic members 8 have the same spring constant. However, a mounting state (condition) of the upper elastic member 81 to (on) the body housing 11 and the movable housing 15 is different from a mounting state (condition) of the lower elastic member 83 to (on) the body housing 11 and the movable housing 15.

More specifically, a mounting load (also called as an initial load) of the upper elastic member 81 is set to be larger than a mounting load of the lower elastic member 83. Here, the mounting load corresponds to a load, when mounting the elastic member 8, applied to the elastic member 8 to cause a specified amount of deformation on the elastic member 8 (to deform the elastic member 8 by a specified amount). In other words, the upper elastic member 81 is mounted to the body housing 11 and the movable housing 15 in a state in which the upper elastic member 81 is compressed by a greater amount than the lower elastic member 83. As shown in FIG. 5, a mounting height D1 (i.e. a distance between the spring receiving part 811 and the spring receiving part 813 in the front-rear direction) of the upper elastic member 81 is smaller than a mounting height D2 (i.e. a distance between the spring receiving part 831 and the spring receiving part 833 in the front-rear direction) of the lower elastic member 83.

With such a difference of the mounting loads, when the movable housing 15 is moved relative to the body housing 11, the lower elastic member 83 is more easily elastically deformed, compared to the upper elastic member 81. More specifically, when the load applied to the movable housing 15 exceeds the mounting load of the lower elastic member 83, the lower elastic member 83 first begins to be deformed, and when the load applied to the movable housing 15 is further increased to exceed the mounting load of the upper elastic member 81, the upper elastic member 81 begins to be deformed. When the movable housing 15 is relatively moved to the closer position, the load of the lower elastic member 83 is smaller than the load of the upper elastic member 81 because the compression amount of the lower elastic member 83 is smaller than the compression amount of the upper elastic member 81. In this manner, the load (biasing force) of the upper elastic member 81 and the load (biasing force) of the lower elastic member 83 can be easily set to be different from each other, using the same compression springs that are mounted in different conditions. The action of the elastic member 8 when the movable housing 15 is relatively moved will be described below in detail.

Hereinafter, internal structures of the housing 10 are described.

Firstly, internal structures of the body housing 11 are described. As shown in FIG. 3, the motor 2 and the driving mechanism 3 are housed in the body housing 11. The driving mechanism 3 includes a gear speed reducing mechanism 31, a motion converting mechanism 33, and a striking mechanism 35.

The motor 2 is disposed in a rear end portion of the body housing 11 (namely, in a rear end portion of the body 113). In the present embodiment, the motor 2 is an AC motor, which is driven by electric power supplied from an external AC power source via a power cord 91. The motor 2 is arranged such that the rotation axis A2 of an output shaft 25 extends in the up-down direction (namely, the rotation axis A2 is orthogonal to the driving axis A1). A portion of the motor 2 (specifically, a portion of a stator and a rotor) is located on the driving axis A1.

The gear speed reducing mechanism 31 is a speed reducing mechanism formed by a plurality of gears. The gear speed reducing mechanism 31 is disposed on a front side of the motor 2 and in an upper end portion of the body housing 11. The gear speed reducing mechanism 31 is configured to reduce the speed of the rotation of the output shaft 25 and then transmit the rotation to the motion converting mechanism 33.

The motion converting mechanism 33 is configured to convert the rotation transmitted from the gear speed reducing mechanism 31 into linear motion. The motion converting mechanism 33 is disposed on the front side of the motor 2 in the body housing 11. In the present embodiment, the motion converting mechanism 33 is formed as a crank mechanism that includes a crank shaft 331, an eccentric pin 333, a connection rod 335, and a piston 337.

The crank shaft 331 is configured to be rotated by the gear speed reducing mechanism 31, around a rotation axis extending in the up-down direction. The crank shaft 331 is disposed above the driving axis A1 and rotatably supported by bearings that are held by an upper wall of the body housing 11 (body 113). The eccentric pin 333 protrudes downward from a crank plate connected to a lower end of the crank shaft 331. The eccentric pin 333 is disposed at a position that is offset from the rotation axis of the crank shaft 331. The connection rod 335 connects the eccentric pin 333 and the piston 337. The piston 337 is slidably disposed in a cylinder 338. The cylinder 338 is disposed coaxially with the tool holder 112 and extends from the barrel 111 to the front end portion of the body 113 along the driving axis A1.

The striking mechanism 35 includes a striker 351 and an impact bolt 353. The striker 351 is a striking element for applying a striking force to the tool accessory 91. The striker 351 is disposed in front of the piston 337 within the cylinder 338 and is slidable along the driving axis A1. A space between the piston 337 and the striker 351 in the cylinder 338 forms an air chamber that serves as an air spring. The impact bolt 353 is an intermediate element that transmits kinetic energy of the striker 351 to the tool accessory 91. The impact bolt 351 is disposed in front of the striker 351 and is slidable within the tool holder 112 along the driving axis A1.

When the piston 337 is reciprocated in the front-rear direction in response to the rotation of the crank shaft 331, the pressure in the air chamber fluctuates, so that the striker 351 slides within the cylinder 338 in the front-rear direction by the action of the air spring. More specifically, when the piston 337 is moved frontward, the pressure in the air chamber increases. The striker 351 is thus pushed forward at high speed by the action of the air spring and strikes the impact bolt 353. The impact bolt 353 transmits the kinetic energy of the striker 351 to the tool accessory 91. Thus, the tool accessory 91 is linearly driven along the driving axis A1. On the other hand, when the piston 337 is moved rearward, the pressure in the air chamber decreases, so that the striker 351 moves rearward. The tool accessory 91 moves rearward together with the impact bolt 353 bay being pressed against a workpiece. In this way, the hammering operation is repeated.

Figure 8:
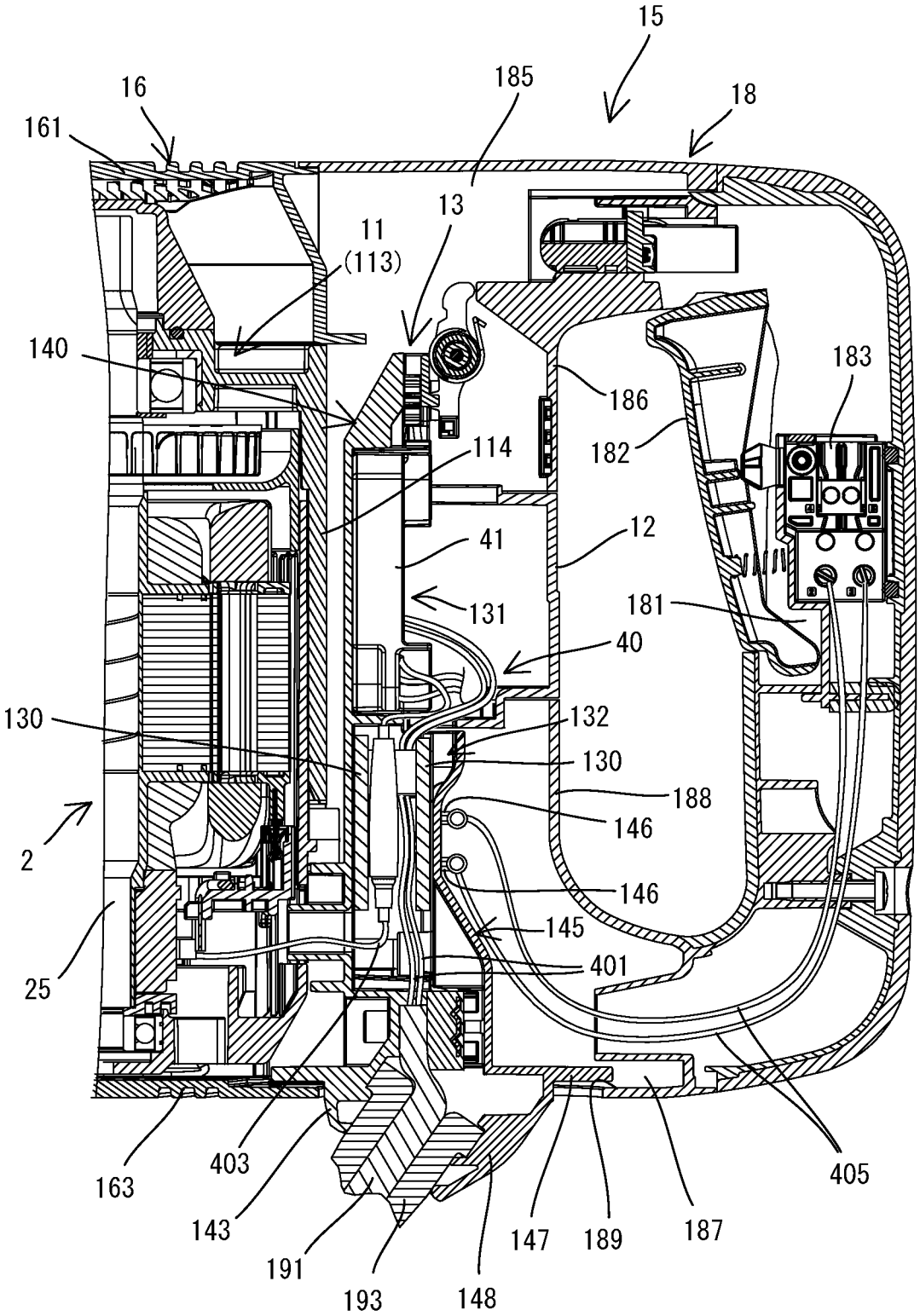
FIG. 8 is a cross-sectional view of the rear end portion of the electric hammer.

Next, internal structures of the movable housing 15 are described. As shown in FIG. 8, a switch 183 is housed in the grip 181 of the handle 18 of the movable housing 15. The switch 183 is normally kept in an OFF state. When the trigger 182 is depressed, the switch 183 is turned ON.

As described above, the controller case 13 is fixed to the rear wall 114 of the body housing 11. As shown in FIG. 4 and FIG. 8, a substantially central portion (the first housing space 131 to be described below) in the up-down direction of the controller case 13 is covered by the rear cover 12. An upper portion and a lower portion of the controller case 13 are covered by the upper connection part 185 and the lower connection part 187 of the handle 18, respectively.

Figure 9:
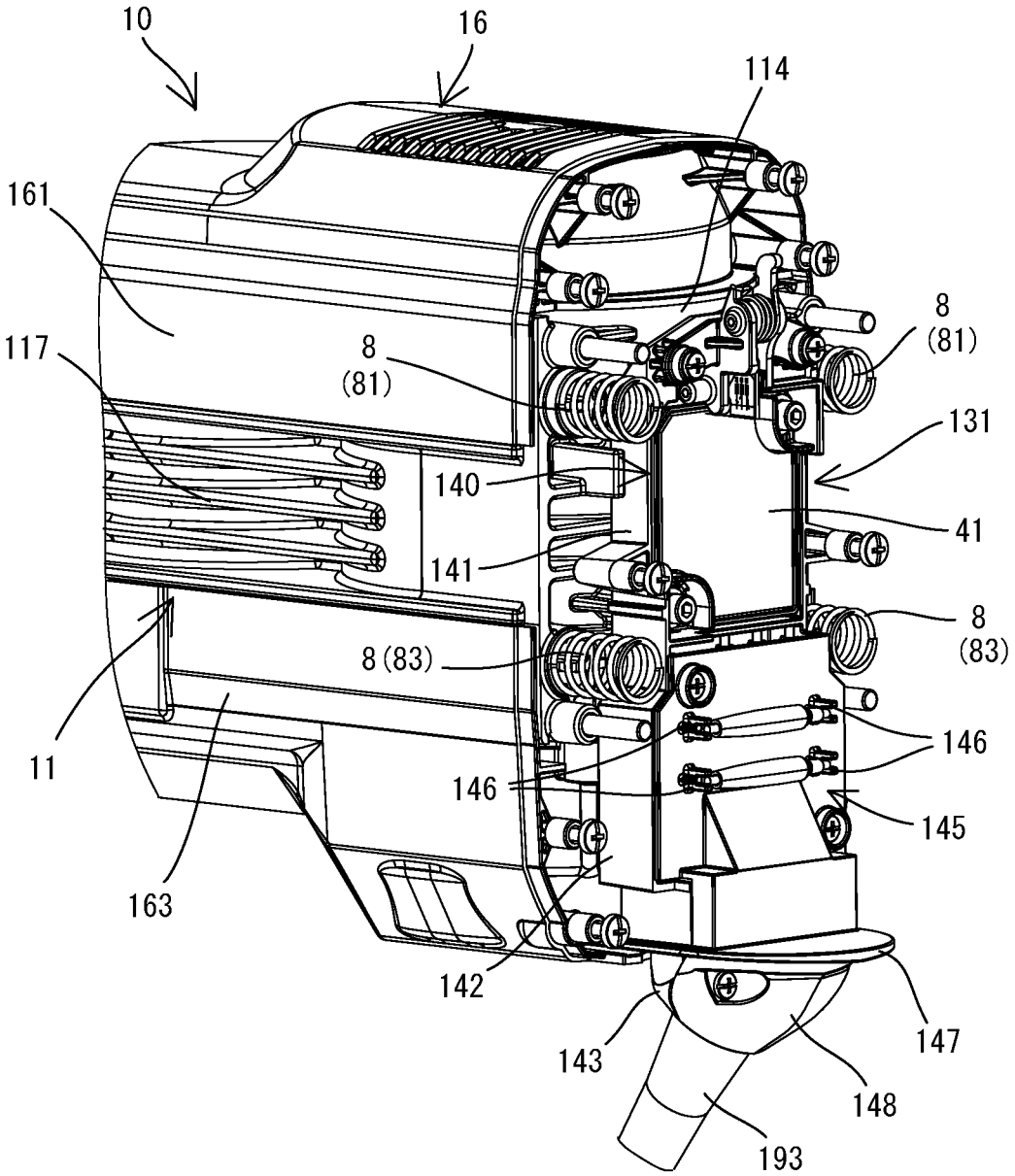
FIG. 9 is a perspective view of the rear end portion of the electric hammer in a state in which the handle and a rear cover are removed (wherein wires are not shown).
Figure 10:
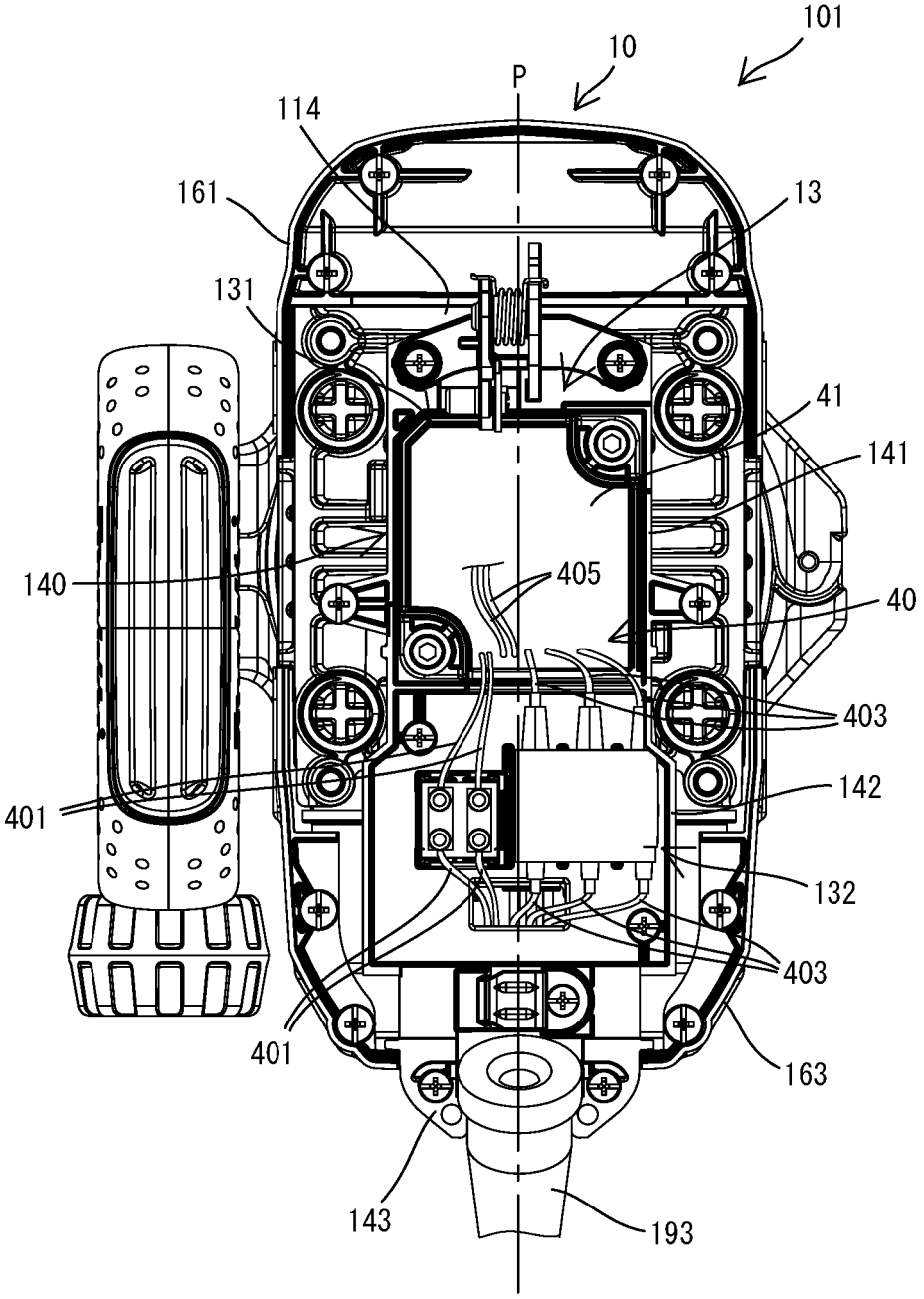
FIG. 10 is a rear view of the electric hammer in a state in which the handle, the rear cover, and a cover of a controller case are removed.

As shown in FIG. 8, FIG. 9 and FIG. 10, in the present embodiment, the controller case 13 houses a controller 41 and portions of various wires 40 (including wires connected via a connector(s)) that are connected to the controller 41 (not shown in FIG. 9). More specifically, the controller case 13 is formed by a case body 140, and a cover 145 that covers a portion of the case body 140. In the present embodiment, each of the case body 140 and the cover 145 is formed of synthetic resin (polymer).

The case body 140 is an elongate rectangular box-like member having an open rear end. The case body 140 has a front wall (bottom wall) having a generally rectangular shape and a peripheral wall protruding rearward from an outer peripheral edge of the front wall. The case body 140 has two housing spaces that are sectioned (divided) in the up-down direction. Hereinafter, in the case body 140, a portion that defines the first housing space 131 that is located on the upper side is referred to as a first housing part 141, and a portion that defines a second housing space 132 that is located on the lower side is referred to as a second housing part 142. In the present embodiment, the first housing space 131 and the second housing space 132 are partitioned by a partition wall. The cover 145 covers a generally entirely a portion of the opening at the rear end of the case body 140 that corresponds to the second housing space 132. The cover 145 is fixed to the case body 140 using screws.

The controller 41 is disposed in the first housing space 131. The controller 41 is a control device configured to control driving of the motor 2. Although not shown in detail, the controller 41 includes a circuit board and a control circuit mounted on the circuit board. The wires 40 are connected to the controller 41. The wires 40 include, for example, wires 401 that connect the power cord 191 and the controller 41, wires 403 that connect the controller 41 and the motor 2 (specifically, a brush holder), wires 405 that connect the controller 41 and the switch 183. The wires 40 are partially disposed in the second housing space 132. In the present embodiment, a portion of the wires 401 and a portion of the wires 403 are disposed in the second housing space 132.

In the present embodiment, the motor 2 is arranged such that the output shaft 25 extends orthogonally to the driving axis A1. In such an arrangement, a space tends to be created along an extension direction of the output shaft 25, adjacent to the motor 2. Thus, in the present embodiment, utilizing such a space, the elongate controller case 13 is fixed to the rear wall 114 such that a longitudinal axis of the controller case 13 extends parallel to the rotation axis of the output shaft 22 of the motor 2. The arrangement of the controller case 13 is also appropriate for housing the wires 403 that connect the controller 41 and the motor 2. In particular, because the wires 403 are connected to the lower end (the brush holder) of the motor 2, the second housing space 132 located below the first housing space 131 facilitates wiring. The wires 403 are inserted into the body housing 11 through openings formed in the front wall (bottom wall) of the case body 140 and the rear wall 114 of the body housing 11.

As shown in FIG. 8, in the present embodiment, cushions 130 are disposed between the portion of the wires 40 arranged in the second housing space 132 and inner surface of the controller case 13. More specifically, the cushions 130 are disposed between the portion of the wires 40 (at least the portion of the wires 403 connected to the motor 2) and an inner surface of the front wall (bottom wall) of the case body 40, and between the portion of the wires 40 (at least the portion of the wires 403) and an inner surface of the cover 145. An elastic member such as sponge formed of synthetic resin (polymer) and rubber can preferably be employed as each of the cushions 130. The cushions 130 can reduce possibility of collision between the inner surface of the controller case 13 and the portion of the wires 40 arranged in the second housing space 132 and thereby protect the wires 40 from the vibration of the body housing 11 and the controller case 40.

Further, holders 146 are provided on a rear surface of the cover 145 (namely, a surface facing the rear wall 188 of the lower connection part 187). The holders 146 are each configured to hold one or more of the wires 40 (or a connector for the wires 40). In the present embodiment, the holder 146 is formed by a pair of flexible projections that are capable of holding the wire(s) 40 and the connector therebetween. In the present embodiment, the holders 146 respectively hold connectors for the wires 405. The wires 405 pass through interiors of the lower connection part 187 and the grip 181 so as to be connected to the switch 183.

The cover 145 has a sliding part 147 slidably engaged with the movable housing 15. More specifically, the sliding part 147 is a plate-like portion that extends rearward from a lower end portion of the cover 145, and is slidably disposed in a recess 189 formed in a lower end portion of the lower connection part 187 of the handle 18.

A portion of the controller case 13 is formed to hold a cord guard 193 for protecting the power cord 191. Thus, the controller case 13, which houses the controller 41 and a portion of the wires 40, is also used for holding the cord guard 193.

More specifically, a front holding part 143 and a rear holding part 148 are provided to lower end portions of the case body 140 and the cover 145 of the controller case 13, respectively. Each of the front holding part 143 and the rear holding part 148 has a recess having a shape that matches the shape of an outer periphery of the cord guard 193. When the cover 145 is fixed to the case body 140, the front holding part 143 and the rear holding part 148 are engaged with the cord guard 193 from the front and the rear, respectively, so as to hold the cord guard 193. The front holding part 143 and the rear holding part 148 both protrude downward from an opening formed in the lower end portion of the movable housing 15 (more specifically, an opening formed over a lower rear end portion of the lower part 163 of the outer housing 16 and a lower front end of the lower connection part 187 of the handle 18).

Figure 11:
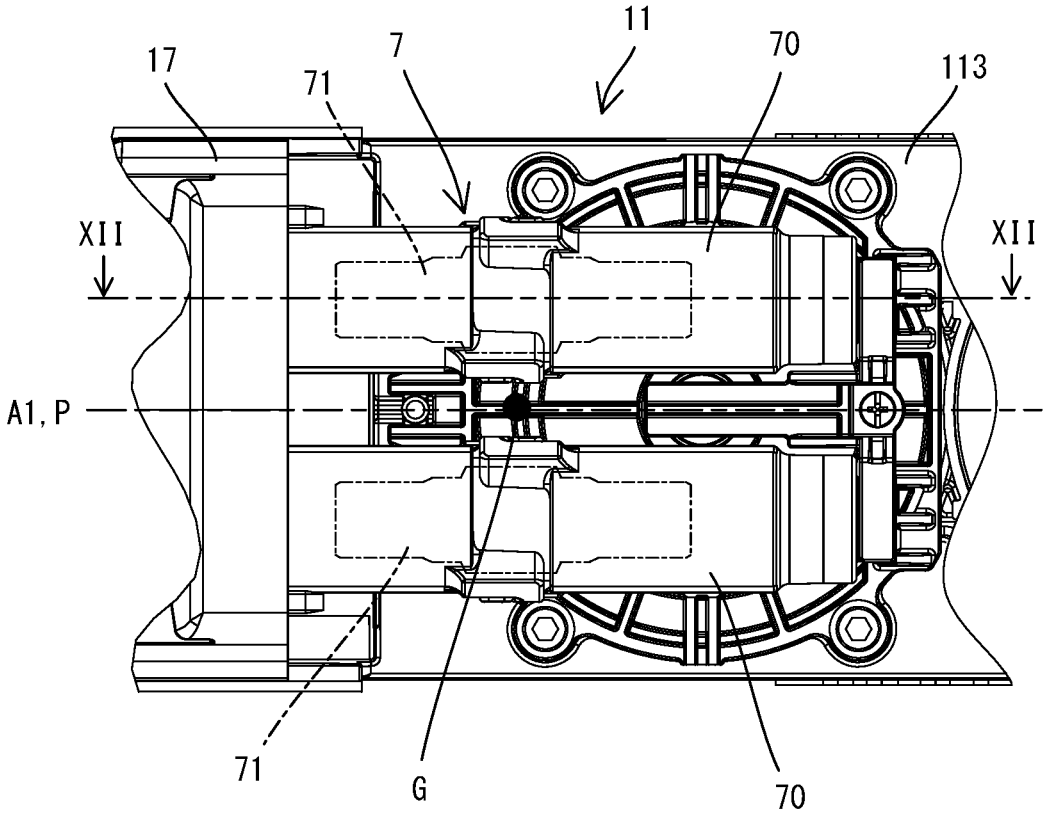
FIG. 11 is a partial bottom view of the electric hammer in a state in which a lower part of an outer housing is removed.

Further, as shown in FIG. 3 and FIG. 11, the hammer 101 includes a vibration control mechanism 7. The vibration control mechanism 7 is configured to reduce vibration in the front-rear direction that is generated in the body housing 11 due to the hammering operation described above. The vibration control mechanism 7 of the present embodiment includes a pair of left and right dynamic vibration reducers 70. The dynamic vibration reducers 70 have the same configuration and are symmetrically arranged with respect to the plane P. The dynamic vibration reducers 70 are mounted to (on) the lower end portion of the body housing 11 and extend parallel to the driving axis A1 in the front-rear direction. The dynamic vibration reducers 70 are covered by the lower part 163 of the outer housing 16.

In the present embodiment, the left and right dynamic vibration reducers 70 are adopted so that each of the dynamic vibration reducers 70 can be minimized in size and a compact arrangement can be achieved as a whole, compared to a configuration in which only one dynamic vibration reducer is configured to effectively reduce the vibration. Further, a rear half of the dynamic vibration reducer 70 and a portion of the motion converting mechanism 33 are disposed on opposite sides of the driving axis A1. More specifically, the crank shaft 331 and the dynamic vibration reducers 70, both of which are heavy components, are disposed above and below the driving axis A1, respectively. When viewed from the left, the rear half of the dynamic vibration reducer 70 is located directly below the crank shaft 331. With such an arrangement, a favorable weight balance can be obtained in the up-down direction. In the hammer 101, there is no particular need for arranging a component in a space opposite to the crank shaft 331 with respect to the driving axis A1 (or directly below the crank shaft 331). Thus, a reasonable arrangement of the vibration control mechanism 7 can be achieved using such a space.

Figure 12:
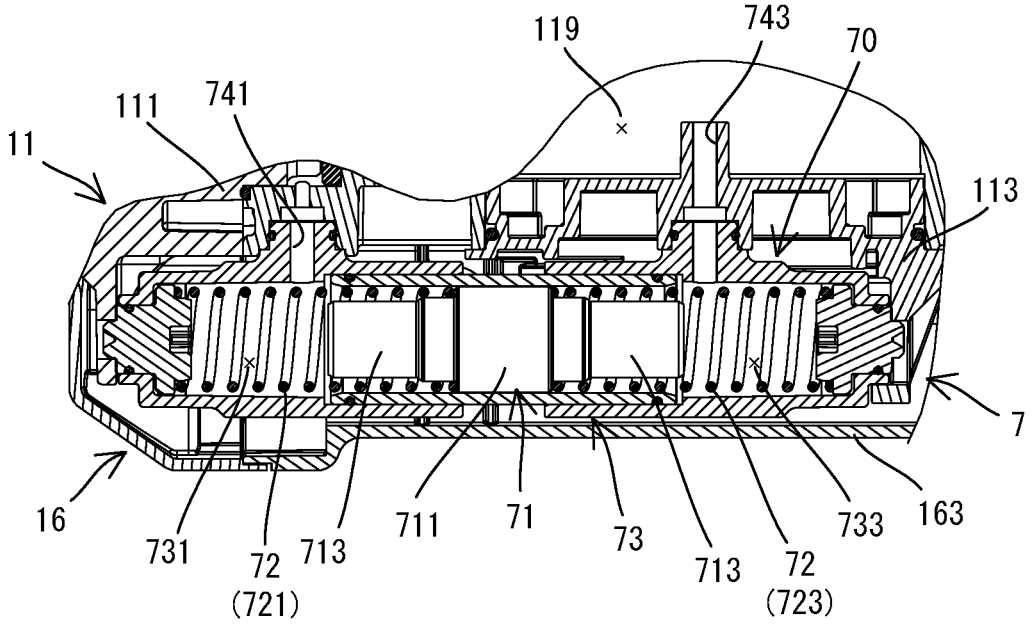
FIG. 12 is a cross-sectional view taken along line XII-XII in FIG. 11 (wherein the lower part is attached.)

As shown in FIG. 12, in the present embodiment, each of the dynamic vibration reducers 70 includes a weight 71, two springs 72 disposed on both sides of the weight 71, and a housing part 73 that houses the weight 71 and the springs 72.

The weight 71 is formed as an elongate solid cylindrical member extending in the front-rear direction. The weight 71 is slidable within the housing part 73 in the front-rear direction. More specifically, the weight 71 has a large-diameter part 711 having a uniform diameter, and small-diameter parts 713 each having a smaller diameter than the large-diameter part 711. The small-diameter parts 713 protrude forward from a front end and rearward from a rear end of the large-diameter part 711, respectively. The two springs 72 are fitted onto the small-diameter parts 713, respectively. One end of each of the springs 72 abuts on an end portion of the large-diameter part 711. The other ends of the springs 72 respectively abut on spring receiving parts, which are formed in opposite ends of the housing part 73. Hereinafter, when the springs 72 are collectively referred to, the springs 72 are simply called as the springs 72. When either one of the springs 72 is referred to without distinction, it is simply called as the spring 72. Of these two springs 72, the spring 72 disposed in front of the weight 71 is specifically called as a front spring 721, and the spring 72 disposed behind the weight 71 is specifically called as a rear spring 723.

The housing part 73 is a circular cylindrical case with both ends closed. In the present embodiment, the housing part 73 is formed by connecting a plurality of components. The housing part 73 is mounted to the lower end portion of the body housing 11 such that a longitudinal axis of the housing part 73 extends in the front-rear direction. An internal space of the housing part 73 is partitioned by the weight 71 (specifically, the large-diameter part 711) into a front space 731 formed in front of the weight 71, and a rear space 733 formed behind the weight 71.

The dynamic vibration reducer 70 of the present embodiment is configured to forcibly vibrate (drive) the weight 71 using pressure fluctuations of air in the barrel 111 and the crank chamber 119. Such a vibration system is generally called as a forcible air-vibration system. The crank chamber 119 is a space defined within the body housing 11 (see FIG. 3). The crank shaft 331 (crank plate) and the eccentric pin 333 are disposed in the crank chamber 119. A front side of the crank chamber 119 is closed by the piston 337 disposed in the cylinder 338. Although not shown in detail, communication between the crank chamber 119 and an outside of the crank chamber 119 is generally inhibited by a sealing structure. The front space 731 of the dynamic vibration reducer 70 communicates with an internal space of the barrel 111 that houses the cylinder 338 (not shown in FIG. 12), via a passage 741. The rear space 733 communicates with the crank chamber 119 via a passage 743.

When the hammering operation is performed, the pressure of the internal space of the barrel 111 and the pressure of the crank chamber 119 respectively fluctuate in response to driving of the motion converting mechanism 33 and the striking mechanism 35 (see FIG. 3). The pressure fluctuations of the internal space of the barrel 111 and the crank chamber 119 are different in phase by approximately 180 degrees. Specifically, when the pressure of the internal space of the barrel 111 increases, the pressure of the crank chamber 119 decreases. On the contrary, when the pressure of the internal space of the barrel 111 decreases, the pressure of the crank chamber increases. Thus, the front space 731 and the rear space 733 of the dynamic vibration reducer 70 communicate with the internal space of the barrel 111 and the crank chamber 119, respectively, so that the weight 71 of the dynamic vibration reducer 70 can be forcibly driven opposite to the piston 337 and the striking mechanism 35 using these pressure fluctuations. With such a system, the vibration can be further effectively reduced. It is noted that the forcible air-vibration system is known, and therefore further detailed description thereof is omitted here.

Hereinafter, the operation of the hammer 101 is described.

Figure 7:
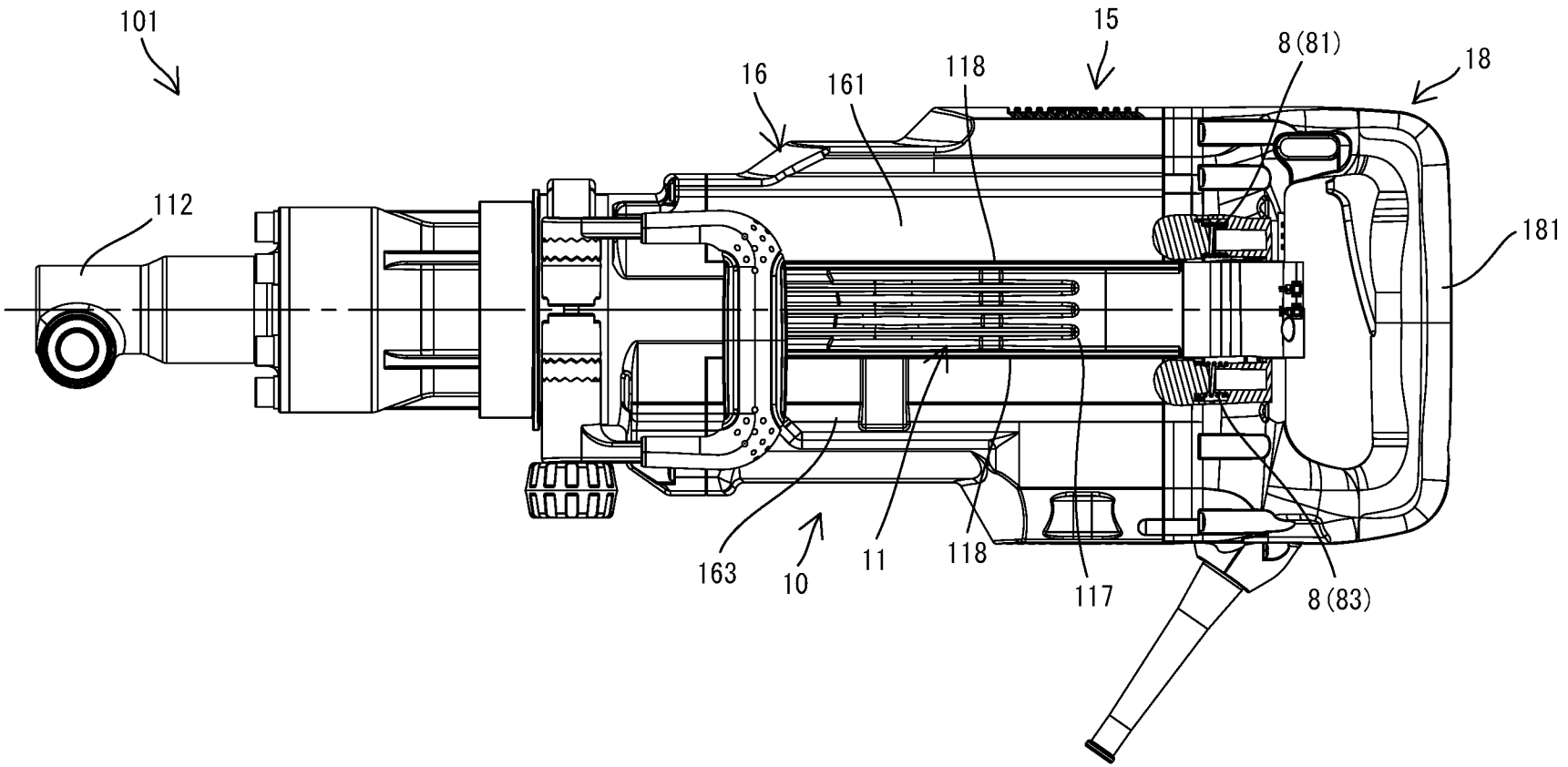
FIG. 7 is an explanatory view of the electric hammer in a state in which the movable housing is located in a closer position.

When the motor 2 is driven, the motion converting mechanism 33 is driven via the gear speed reducing mechanism 31. The weights 71 of the dynamic vibration reducers 70 are reciprocated opposite to the piston 337 and the striker 351 in response to the reciprocation of the piston 337 and the striker 351 in the front-rear direction, and thereby reduce the vibration generated in the body housing 11 in the front-rear direction. Further, as shown in FIG. 6 and FIG. 7, the body housing 11 and the movable housing 15 connected via the elastic members 8 move relative to each other within a range between the initial position and the closer position in the front-rear direction. Therefore, transmission of the vibration from the body housing 11 to the movable housing 15 can be reduced.

In the present embodiment, as described above, the dynamic vibration reducers 70 are mounted to the lower end portion of the body housing 11. Thus, as shown in FIG. 11, in an initial state (when the weights 71 are not driven), the center of gravity G of the pair of weights 71 as a whole is located at substantially the same position as the driving axis A1 in the left-right direction. On the other hand, as shown in FIG. 3, the center of gravity G is offset from the driving axis A1 in the up-down direction. More specifically, the center of gravity G is located below the driving axis A1. Thus, the center of gravity G is located substantially directly below the driving axis A1. In such an arrangement, vibration in the front-rear direction generated in the body housing 11 can be effectively reduced. On the other hand, a certain amount of vibration is generated in the up-down direction. It is considered that the vibration in the up-down direction is subjected to an influence of, in particular, the impact that is generated when the piston 337 and the striker 351 move frontward and thereby the impact bolt 353 strikes the tool accessory 91 and the weights 71 of the dynamic vibration reducers 70 move rearward.

In the present embodiment, the mounting load of each of the lower elastic members 83, which are closer to the center of gravity G of the weights 71 in the up-down direction, is set to be smaller than the mounting load of each of the upper elastic members 81. Thus, the lower elastic members 83 are elastically deformed more easily than the upper elastic members 81 and can absorb the impact effectively. Consequently, transmission of the vibration in the up-down direction to the movable housing 15 can be effectively reduced. In particular, in the present embodiment, the lower elastic members 83 are disposed on the same side as the center of gravity G with respect to the driving axis A1, and the upper elastic members 81 are disposed on a side opposite to the center of gravity G with respect to the driving axis A1. Thus, the transmission of the vibration in the up-down direction to the movable housing 15 can be further effectively reduced. Further, stability of gripping the grip 181, which extends in the up-down direction, can be favorably secured. In this manner, in the present embodiment, a reasonable configuration is realized that can suppress the transmission of the vibration to the movable housing 15 while arranging the vibration control mechanism 7 at a position offset from the driving axis A1.

In the present embodiment, the wires 40 connected to the controller 41 are partially disposed in the second housing space 132, which is adjacent to the first housing space 131 in which the controller 41 is disposed, within the controller case 13. Further, the wires 40 in the second housing space 132 are partially covered by the cushions 130, each of which is disposed between the wires 40 and the inner surface of the controller case 13. With such a configuration, even if the vibration is generated in response to driving of the hammer 101, an influence of the vibration on the portion of the wires 40 disposed within the second housing space 132 can be reduced and thereby the wires 40 can be protected.

The second housing space 132 is covered not only by the case body 140 but also by the cover 145. With such a configuration, there is less possibility that the wires 40 come out of the controller case 13. Thus, the wires 40 can be further stably held in the controller case 13. In particular, in the present embodiment, even when the movable housing 15 is moved frontward relative to the body housing 11, the cover 145 can reduce possibility that the wires 40 contact a portion of the movable housing 15 (specifically, the rear wall 188 of the lower connection part 187), so that the wires 40 can be further reliably protected.

As described above, the sliding guides 118 provided along the exposure regions 117 guide the relative movement of the outer housing 16 in the front-rear direction. In addition, the sliding part 147 of the cover 145 slides within the recess 189 formed in the lower end portion of the lower connection part 187, and thereby guides the relative movement of the handle 18 in the front-rear direction.

Correspondences between the features of the embodiment described above and the features of the present disclosure are as follows. However, the features of the above-described embodiment are merely exemplary, and therefore the features of the present disclosure are not limited to such examples. The electric hammer 101 is an example of the "reciprocating tool". The motor 2 and the output shaft 25 are examples of the "motor" and the "output shaft", respectively. The driving mechanism 3 and the piston 337 are examples of the "driving mechanism" and the "reciprocating member", respectively. The driving axis A1 is an example of the "driving axis". The body housing 11 is an example of the "body housing". The movable housing 15 and the grip 181 are examples of the "movable part" and the "grip", respectively. The lower elastic member 83 and the upper elastic member 81 are examples of the "first elastic member" and the "second elastic member", respectively. The vibration control mechanism 7 and the weight 71 are examples of the "vibration control mechanism" and the "weight", respectively.

The motion converting mechanism 33 is an example of the "motion converting mechanism". The crank shaft 331 and the eccentric pin 333 are examples of the "crank shaft" and the "eccentric pin", respectively. The dynamic vibration reducer 70 is an example of the "dynamic vibration reducer". The spring receiving parts 831 and 833 are an example of the "two first spring receiving parts". The spring receiving parts 811 and 813 are an example of the "two second spring receiving parts".

The embodiment described above is merely an exemplary embodiment, and therefore a reciprocating tool according to the present disclosure is not limited to the hammer 101 described above. For example, the following modifications may be made. One or more of these modifications may be adopted in combination with the hammer 101 of the above-described embodiment or the claimed feature(s).

In the above-described embodiment, the hammer 101 is described as an example of the reciprocating tool. However, the reciprocating tool that is configured to linearly drive the tool accessory in response to reciprocation of the reciprocating member is not limited to the hammer 101. For example, the reciprocating tool may be a rotary hammer that is capable of performing a drilling operation of rotationally driving a tool accessory, in addition to the hammering operation of linearly driving the tool accessory. The hammer 101 and the rotary hammer are examples of a power tool having a hammer mechanism. Further, the reciprocating tool may be a reciprocating cutting tool (for example, a reciprocating saw, a saber saw, and a jigsaw) that is configured to cut a workpiece using a tool accessory.

The configurations and the arrangements of the motor 2, the driving mechanism 3, the body housing 11 that houses the motor 2 and the driving mechanism 3, and the movable housing 15 having the grip 181 may be changed as needed, in accordance with the reciprocating tool. Hereinafter, exemplary modifications that can be adopted therein will be described.

The motor 2 may be a brushless motor, instead of the motor having a brush. The motor 2 may be a DC motor. In this case, a battery-mounting part, to which a battery (for example, a rechargeable battery, which is also called a battery pack) is detachably attachable, may be provided in the body housing 11. A well-known motion converting mechanism including a oscillating member may be adopted as the motion converting mechanism 33 of the driving mechanism 3, in place of the crank mechanism in the above-described embodiment. The motor 2 need not necessarily be arranged such that the output shaft 25 is orthogonal to the driving axis A1. For example, the motor 2 may be arranged such that the output shaft 25 obliquely intersects the driving axis A1 or the output shaft 25 is parallel to the driving axis A1.

A shape of each of the body housing 11 and the movable housing 15 may be changed as needed. For example, in the above-described embodiment, the movable housing 15, which is elastically connected to the body housing 11, has a structure that partially covers the body housing 11. However, a portion of the body housing 11 and a range thereof covered by the movable housing 11 are not limited to the example described in the embodiment. The sliding parts for guiding the relative movement between the body housing 11 and the movable housing 15 in the front-rear direction are not limited to the sliding guides 118. For example, a single sliding guide may be disposed at one position in the up-down direction. Further, a plurality of sliding parts may be respectively disposed at a plurality of positions that are different from the positions described in the above-described embodiment. Alternatively, the sliding parts may be omitted.

In place of the movable housing 15, a handle that includes a grip configured to be gripped by a user may be elastically connected to the body housing 11. The handle need not substantially cover the body housing 11. The handle need not be arranged on the driving axis A1, and the handle may include a pair of grips protruding in the up-down direction or in the left-right direction relative to the body housing 11.

In the above-described embodiment, the controller case 13 is disposed on the rear wall 114 of the body housing 11 and houses the controller 41 and a portion of the wires 40. However, the controller case 13 may be omitted. For example, the controller 41 may be disposed in the body housing 11 or in the movable housing 15, and may be connected to various electrical components via the wires 40.

The structures, the positions and the number of the dynamic vibration reducers 70 may be changed as needed.

For example, it is sufficient as long as the dynamic vibration reducer 70 includes a weight and at least one spring. That is, the number of the springs may be one or three or more. At least a portion of the housing part 73 may be formed by a portion of the body housing 11. In the above-described embodiment, the dynamic vibration reducer 70 employs the forcible air-vibration system, which uses the pressure fluctuations in the barrel 111 and the crank chamber 119 to forcibly vibrate (drive) the weight 71. However, the dynamic vibration reducer 70 may be formed as a normal dynamic vibration reducer that does not forcibly vibrate (drive) the weight 71. The internal space of the housing part 73 may communicate with only the crank chamber 119 so that the weight 71 is forcibly vibrated using only the pressure fluctuations in the crank chamber 119. Alternatively, the weight 71 may be mechanically vibrated (driven) by a component, instead of being vibrated (driven) by the pressure fluctuations of the air. For example, the weight 71 may be mechanically vibrated by a lever connected to the crank shaft 331. The vibration control mechanism 7 may be formed by a mechanism including at least one counter weight, instead of the dynamic vibration reducer 70.

The number of the dynamic vibration reducers 70 may be one or three or more. For example, a single dynamic vibration reducer 70 may be mounted to (on) the lower end portion of the body housing 11 such that the dynamic vibration reducer 70 extends parallel to the driving axis A1 on the plane P. Alternatively, for example, two dynamic vibration reducers 70 may be mounted on the left side and the right side of the body housing 11.

The number, the positions and the types of the elastic members 8 interposed between the body housing 11 and the movable housing 15 may also be changed as needed.

For example, any number of the elastic members 8 may be employed, as long as the elastic members 8 include at least two elastic members 8 that are spaced apart from each other in a direction of an axis that is orthogonal to the driving axis A1 and that passes the driving axis A1 and the center of gravity of the at least one weight 71. Further, the load, when the movable housing 15 is placed in the closer position, of one of the two elastic members 8, which is closer to the center of gravity of the at least one weight 71, may be set to be smaller than the load of the other of the two elastic members 8. Thus, for example, in an embodiment in which the center of gravity of the weight 71 is offset from the driving axis A1 to the left or to the right, the two elastic members 8 may be arranged to be spaced apart from each other in the left-right direction.

Further, in the above-described embodiment, by employing the upper elastic member 81 and the lower elastic member 83 having the same configuration and setting the mounting states (conditions) (specifically, the mounting load or the mounting height) of the upper and lower elastic members 81 and 83 to be different from each other, the load of the upper elastic member 81 and the load of the lower elastic member 83 when the movable housing 15 is located at the closer position are set to be different from each other. Instead of this configuration, for example, the upper elastic member 81 and the lower elastic member 83 may be elastic members having different spring constants, respectively. More specifically, an elastic member (for example, a compression coil spring), which has a spring constant that is smaller (i.e. which is more flexible) than a spring constant of the upper elastic member 81, may be adopted as the lower elastic member 83. In this case, the load of the lower elastic member 83 when the movable housing 15 is located at the closer position can be made smaller than the load of the upper elastic member 81, even in a case in which the mounting load of the upper elastic member 81 and the load of the lower elastic member 83 are identical. Also in this case, similar to the above-described embodiment, a reasonable configuration can be obtained that can effectively suppress transmission of the vibration to the movable housing 15 while arranging the vibration control mechanism 7 at a position offset from the driving axis A1.

Further, a different kind of a spring other than the compression coil spring, rubber, synthetic resin (polymer) having elasticity (for example, urethane foam), felt or the like may be adopted as the elastic member 8.

The following aspects may be provided in view of the present invention and the above-described embodiment. At least one of the following aspects can be employed in combination with any one or more of the above-described embodiment, the modifications thereof, and the claimed features.

(Aspect 1)

The driving mechanism incudes a striking mechanism configured to strike the tool accessory by an action of an air spring, in response to the reciprocation of the reciprocating member.

The striking mechanism 35 is an example of "the striking mechanism" in this aspect.

(Aspect 2)

The output shaft extends in the second direction.

(Aspect 3)

The reciprocating tool further comprises a sliding guide that is configured to guide movement of the movable part in the first direction relative to the body housing.

The sliding guide 118 is an example of "the sliding guide" in this aspect.

(Aspect 4)

The at least one dynamic vibration reducer includes a housing part that houses the weight and the at least one spring, a first internal space, in which the motion converting mechanism is disposed, is defined within the body housing, the first internal space communicates with a second internal space of the housing part of the at least one dynamic vibration reducer, and the weight is forcibly vibrated by pressure fluctuations of air within the first internal space that is generated in response to driving of the motion converting mechanism.

The weight 71, the spring 72, and the housing part 73 are examples of the "weight", the "spring", and the "housing part", respectively. The crank chamber 119 is an example of the "first internal space". The rear space 733 is an example of the "second internal space".

Further, with an aim to provide techniques for protecting a wire connected to a controller of a power tool, the following Aspects 5 to 16 may be provided. Each one of the following Aspects 5 to 16 may be employed individually or in combination with any one or more of the other aspects. Alternatively, at least one of the following Aspects 5 to 16 can be employed in combination with at least one of the hammer 101 of the above-described embodiment, the above-described modifications, the above-described aspects and the claimed features.

(Aspect 5)

A power tool comprising:

a controller configured to control an operation of the power tool;

a first wire connected to the controller;

a case having a first housing space in which the controller is disposed and a second housing space in which a portion of the first wire is disposed; and a cushion disposed between an inner surface of the case and the portion of the first wire disposed in the second housing space.

According to this aspect, the portion of the first wire connected to the controller is disposed in the single case together with the controller, but in a housing space (i.e. the second housing space) that is different from a housing space for the controller. Further, the cushion is disposed between the portion of the first wire and the inner surface of the case. Therefore, the cushion can reduce an influence of vibration, which is generated in response to driving of the power tool, on the portion of the first wire disposed in the second housing space. Thus, the first wire can be protected from the vibration. Here, the first wire in this aspect may refer to at least one of various kinds of wires that connect the controller and various electrical components of the power tool. Examples of the first wire in this aspect include a wire that connects the controller and the motor, a wire that connects the controller and a power source, and a wire that connects the controller and a switch or a sensor. It is noted that a connector or another wire, in addition to the first wire, may be interposed between the controller and the motor, between the controller and the power source, and between the controller and the switch/sensor, as long as they are connected via the first wire.

(Aspect 6)

The power tool according to Aspect 5, wherein:

the case includes a box-like body and a cover, the body has an opening, and the cover is configured to at least partially cover a portion of the opening that corresponds to the second housing space.

According to this aspect, the portion of the first wire disposed in the second housing space can be stably held and protected in the case by the cover.

(Aspect 7)

The power tool according to Aspect 5 or 6, further comprising a motor connected to the controller via the first wire, wherein the case is an elongate hollow body and disposed adjacent to the motor such that a longitudinal axis of the case extends parallel to a rotation axis of an output shaft of the motor.

According to this aspect, a reasonable configuration of the case is realized that can effectively protect the first wire connecting the controller and the motor.

(Aspect 8)

The power tool according to any one of Aspects 5 to 7, further comprising a motor connected to the controller via the first wire, wherein:

the power tool has a hammer mechanism that is configured to linearly drive a tool accessory along a driving axis using power from the motor, a rotation axis of an output shaft of the motor intersects the driving axis, and the case is disposed adjacent to the motor.

In the power tool having the hammer mechanism, relatively large vibration is generated in response to driving of the hammer mechanism. In a configuration in which the output shaft of the motor intersects the driving axis, a space tends to be created adjacent to the motor. According to this aspect, by using this space, a reasonable configuration of the case is realized that can effectively protect the first wire from the vibration of the impact tool.

(Aspect 9)

The power tool according to Aspect 8, further comprising:

a body housing that houses the motor; and a movable part that is connected to the body housing via at least one elastic member so as to be movable relative to the body housing, the movable part including a grip configured to be gripped by a user, wherein the case is disposed in the body housing.

According to this aspect, the first wire can be protected by the cushion while the case is disposed in the body housing that houses the motor, which may become a vibration source.

(Aspect 10)

The power tool according to Aspect 9, wherein at least a portion of the movable part is located on a side opposite to the motor with respect to the case in an extension direction of the driving axis.

(Aspect 11)

The power tool according to Aspect 9 or 10, wherein:

the case includes a box-like body and a cover, the body has an opening, and the cover is configured to at least partially cover a portion of the opening that corresponds to the second housing space and partially overlap with the movable part such that the cover guides movement of the movable part relative to the body housing.

(Aspect 12)

The power tool according to any one of Aspects 6 to 11, further comprising:

a power cord that is connectable to an external power source; and a protection cover that covers a portion of the power cord, wherein a portion of the body and a portion of the cover are configured to hold the protection cover.

According to this aspect, the case that houses a portion of the first wire can also be used effectively for holding the protection cover for the power cord.

(Aspect 13)

The power tool according to any one of Aspects 6 to 12, further comprising:

a motor connected to the controller via the first wire; and a switch for activating the motor, connected to the controller via a second wire, wherein a holder configured to hold a portion of the second wire is provided on an outer surface of the cover.

According to this aspect, the case that houses a portion of the first wire connected to the motor can also be used effectively for holding a portion of the second wire connected to the switch.

(Aspect 14)

The cushion is disposed between the inner surface of at least one of the body and the cover and a the portion of the first wire, or disposed around the portion of the first wire.

(Aspect 15)

The power tool further comprises a motor, wherein the first wire is a wire that connects the controller and the motor, or a wire that connects the controller and a power source.

(Aspect 16)

The case and the body housing respectively have openings communicating with each other, and the first wire is connected to the motor through the openings.

Correspondences between the features of the embodiment described above and the features of Aspects 5 to 16 are as follows. However, features of the embodiment are merely exemplary, and therefore the features of Aspects 5 to 16 are not limited to such examples. The electric hammer 101 is an example of the "power tool" and the "power tool having a hammer mechanism". The controller 41 is an example of the "controller". The wire 40 is an example of the "first wire". The controller case 13, the first housing space 131, and the second housing space 132 are examples of the "cover", the "first housing space", and the "second housing space", respectively. The cushion 130 is an example of the "cushion". The case body 140 and the cover 145 are examples of the "body" and the "case", respectively. The motor 2 is an example of the "motor". The body housing 11 is an example of the "body housing". The movable housing 15 and the grip 181 are examples of the "movable part" and the "grip", respectively. The elastic member 8 is an example of the "elastic member". The power cord 191 and the cord cover 193 are examples of the "power cord" and the "protection cover", respectively. The switch 183 is an example of the "switch". The holder 146 is an example of the "holder".

The power tool according to any one of Aspects 5 to 16 is not limited to the hammer 101 described in the above-described embodiment. For example, the following modifications can be made. At least one of these modifications can be adopted in combination with at least one of the hammer 101 of the above-described embodiment, the above-described modifications, the aspects and the claimed features.

In the above-described embodiment, the hammer 101 is described as an example of the power tool having a hammer mechanism. However, the present disclosure can be applied to a general power tool that uses the electric power as power (for example, a tool used for processing, construction, gardening, etc.). Examples of the power tool include a reciprocating tool (a power tool with a hammer mechanism, a reciprocating cutting tool, etc.), an oscillating tool, and a rotary tool. In particular, the present disclosure can be suitably applied to the power tool in which relatively large vibration is generated (for example, a reciprocating tool, and an oscillating tool).

The configurations and the arrangements of the motor 2, the driving mechanism 3, and the housing 10 may be changed as needed in accordance with the power tool. Hereinafter, the modifications that can be adopted therein will be described.

The motor 2 may be a brushless motor, instead of the motor having a brush. The motor 2 may be a DC motor. In this case, a battery-mounting part, to which a battery (for example, a rechargeable battery, which is also called a battery pack) is physically and electrically connectable, may be provided in the body housing 11. In this case, one or more of the wires 40 may connect the controller 41 and the battery-mounting part.

A shape of each of the body housing 11 and the movable housing 15 may be changed as needed. For example, in the above-described embodiment, the movable housing 15, which is elastically connected to the body housing 11, has a structure that partially covers the body housing 11. However, a portion of the body housing 11 and a range thereof covered by the movable housing 11 are not limited to the example described in the above-described embodiment. The sliding parts for guiding the relative movement between the body housing 11 and the movable housing 15 in the front-rear direction are not limited to the sliding guides 118. For example, a single sliding guide may be disposed at one position in the up-down direction. Further, a plurality of sliding parts may be respectively disposed at a plurality of positions that are different from those described in the above-described embodiment. Alternatively, the sliding parts may be omitted.

In place of the movable housing 15, a handle that includes a grip configured to be gripped by a user may be elastically connected to the body housing 11. The handle need not substantially cover the body housing 11. The number of the elastic members 8 interposed between the body housing 11 and the movable housing 15, and the positions and the type of the elastic members 8 may also be changed as needed. For example, a different kind of a spring other than the compression coil spring, rubber, synthetic resin (polymer) having elasticity (for example, urethane foam), felt or the like may be adopted as the elastic member 8. Further, the housing 10 is not necessarily formed as a vibration-isolating housing.

The structures, the positions and the number of the dynamic vibration reducers 70 of the vibration control mechanism 7 may be changed as needed. For example, the vibration control mechanism 7 may include a dynamic vibration reducer having a configuration different from the configuration of the dynamic vibration reducer 70. Alternatively, the vibration control mechanism 7 may be a mechanism including at least one counter weight. The vibration control mechanism 7 may be omitted.

The structure and position of the controller case 13, and the structures, the positions and the number of the cushions 130 may be changed as needed.

For example, the first housing space 131, in which the controller 41 is disposed, may be disposed in a central portion of the controller case 13 (a box-like body), and the second housing space 132, in which a portion of at least one of the wires 40 is disposed, may be disposed around the first housing space 131. The cover 145 may entirely cover the opening of the case body 140 (namely, portions that correspond to both the first housing space 131 and the second housing space 132). Alternatively, the cover 145 may partially cover the portion that corresponds to the second housing space 132. In a case in which the wires 403 connected to the motor 2 are partially disposed in the second housing space 132, the controller case 13 is preferably disposed adjacent to the motor 2. On the hand, in a case in which the wires 40 connected to another electrical component (for example, a sensor) are partially disposed in the second housing 132, the controller case 13 is preferably disposed adjacent to that electrical component.

In the above-described embodiment, the cushions 130 are disposed between the front wall (bottom wall) of the case body 140 and the wires 40, and between the cover 145 and the wires 40. However, only one of the cushions 130 may be disposed. Further, the entire periphery of the wires 40 (the wires 40 here may include a connector) may be covered by the cushion 130. For example, the wires 40 may be inserted through a cylindrical sleeve, which is formed by a sponge or the like and serves as the cushion 130. In this case, the wires 40 can be more effectively protected. Further, the cushion 130 may be formed to cover the wires 40 disposed in the second housing space 132, so that the cushion 130 is used as a substitute of the cover 145.

DESCRIPTION OF REFERENCE NUMERALS

101: electric hammer (hammer), 10: housing, 11: body housing, 111: barrel, 112: tool holder, 113: body, 114: rear wall, 117: exposure region, 118: sliding guide, 119: crank chamber, 12: rear cover, 13: controller case, 130: cushion, 131: first housing space, 132: second housing space, 140: case body, 141: first housing part, 142: second housing part, 143: front holding part, 145: cover, 146: holder, 147: sliding part, 148: rear holding part, 15: movable housing, 16: outer housing, 161: upper portion, 163: lower portion, 17: barrel cover, 18: handle, 181: grip, 182: trigger, 183: switch, 185: upper connection part, 186: rear wall, 187: lower connection part, 188: rear wall, 189: recess, 191: power cord, 193: cord guard, 2: motor, 25: output shaft, 3: driving mechanism, 31: gear speed reducing mechanism, 33: motion converting mechanism, 331: crank shaft, 333: eccentric pin, 335: connection rod, 337: piston, 338: cylinder, 35: striking mechanism, 351: striker, 353: impact bolt, 40 (401, 403, 405): wiring, 41: controller, 7: vibration control mechanism, 70: dynamic vibration reducer, 71: weight, 711: large-diameter part, 713: small-diameter part, 72: spring, 721: front spring, 723: rear spring, 73: housing part, 731: front space, 733: rear space, 741: passage, 743: passage, 8: elastic member, 81: upper elastic member, 811: spring receiving part, 813: spring receiving part, 83: lower elastic member, 831: spring receiving part, 833: spring receiving part, 91: tool accessory, 93: auxiliary handle, A1: driving axis, A2: rotation axis, G: center of gravity, P: plane.

What is claimed is:

1. A reciprocating tool comprising:

a motor having an output shaft;

a driving mechanism that includes a reciprocating member configured to reciprocate along a driving axis in a first direction using power from the motor, the driving mechanism being configured to linearly drive a tool accessory in response to reciprocation of the reciprocating member;

a body housing that houses the motor and the driving mechanism;

a movable part that is connected to the body housing via a first elastic member and a second elastic member such that the movable part is movable relative to the body housing in the first direction between an initial position and a closer position, the movable part being closer to the body housing in the closer position than in the initial position, the movable part including a grip configured to be gripped by a user; and a vibration control mechanism in the body housing and including at least one weight, the vibration control mechanism being configured such that the at least one weight moves in a direction opposite to the reciprocating member in response to the reciprocation of the reciprocating member, wherein:

a center of gravity of the at least one weight is offset from the driving axis in a second direction orthogonal to the driving axis;

in the second direction, the first elastic member is closer to the center of gravity than the second elastic member;

the first elastic member, the second elastic member and the movable part are configured such that a first elastic member mounting load on the first elastic member is smaller than a second elastic member mounting load on the second elastic member;

the driving mechanism includes a crank shaft that is (i) operably coupled to the output shaft and (ii) configured to convert rotation of the output shaft into linear motion of the reciprocating member; and the at least one weight and the crank shaft are on opposite sides of the driving axis in the second direction.

2. The reciprocating tool according to claim 1, wherein the grip extends in the second direction.

3. The reciprocating tool according to claim 1, wherein, in the second direction, the first elastic member and the center of gravity are on one side of the driving axis, and the second elastic member is on an opposite side of the driving axis from the one side.

4. The reciprocating tool according to claim 1, wherein:

a portion of the motor is on the driving axis, and a rotation axis of the output shaft intersects the driving axis.

5. The reciprocating tool according to claim 4, wherein:

the motor is between the driving mechanism and the grip in the first direction, and a portion of the grip is on the driving axis.

6. The reciprocating tool according to claim 1, wherein, when viewed in a third direction that is orthogonal to both of the first direction and the second direction, a rotation axis of the crank shaft extends in the second direction and intersects the vibration control mechanism.

7. The reciprocating tool according to claim 1, wherein the vibration control mechanism includes at least one dynamic vibration reducer.

8. The reciprocating tool according to claim 7, wherein the at least one dynamic vibration reducer includes the at least one weight and at least one spring.

9. The reciprocating tool according to claim 8, wherein the at least one spring includes a pair of springs on opposite sides of the at least one weight in the first direction.

10. The reciprocating tool according to claim 7, wherein the at least one dynamic vibration reducer includes a pair of dynamic vibration reducers aligned in a third direction that is orthogonal to both of the first direction and the second direction.

11. The reciprocating tool according to claim 1, wherein:

the first elastic member and the second elastic member are springs having the same configuration, and a mounting state of the first elastic member to the body housing and the movable part is different from a mounting state of the second elastic member to the body housing and the movable part.

12. The reciprocating tool according to claim 11, wherein:

opposite end portions of the first elastic member are supported by two first spring-receiving parts, opposite end portions of the second elastic member are supported by two second spring-receiving parts, and a distance between the two first spring-receiving parts is larger than a distance between the two second spring-receiving parts.

13. The reciprocating tool according to claim 2, wherein, in the second direction, the first elastic member and the center of gravity are on one side of the driving axis, and the second elastic member is on an opposite side of the driving axis from the one side.

14. The reciprocating tool according to claim 13, wherein:

a portion of the motor is on the driving axis, and a rotation axis of the output shaft intersects the driving axis.

15. The reciprocating tool according to claim 14, wherein:

the motor is between the driving mechanism and the grip in the first direction, and a portion of the grip is on the driving axis.

16. The reciprocating tool according to claim 15, wherein:

the first elastic member and the second elastic member are springs having the same configuration, and a mounting state of the first elastic member to the body housing and the movable part is different from a mounting state of the second elastic member to the body housing and the movable part.

17. The reciprocating tool according to claim 16, wherein:

opposite end portions of the first elastic member are supported by two first spring-receiving parts, opposite end portions of the second elastic member are supported by two second spring-receiving parts, and a distance between the two first spring-receiving parts is larger than a distance between the two second spring-receiving parts.

* * * * *